US007817941B2

(12) United States Patent
Tokimatsu

(10) Patent No.: US 7,817,941 B2
(45) Date of Patent: Oct. 19, 2010

(54) COLOR IMAGE FORMING APPARATUS HAVING DEVELOPING DEVICES WITH DIFFERENT STORAGE CAPACITIES

(75) Inventor: Hiroyuki Tokimatsu, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 369 days.

(21) Appl. No.: 11/961,800

(22) Filed: Dec. 20, 2007

(65) Prior Publication Data

US 2008/0199228 A1 Aug. 21, 2008

(30) Foreign Application Priority Data

Feb. 16, 2007 (JP) ..... 2007-036053

(51) Int. Cl.
*G03G 15/01* (2006.01)

(52) U.S. Cl. ..... 399/223; 399/275; 399/299

(58) Field of Classification Search ..... 399/54, 399/223, 226, 227, 228, 267, 272, 273, 274, 399/275, 277, 299
See application file for complete search history.

(56) References Cited

U.S. PATENT DOCUMENTS 4,591,261 A * 5/1986 Saruwatari et al. ..... 399/167
4,691,663 A * 9/1987 Tachibana et al. ..... 399/230
4,710,016 A * 12/1987 Waatanabe ..... 399/228
4,792,225 A * 12/1988 Itaya ..... 399/223
4,916,490 A * 4/1990 Tanaka et al. ..... 399/119
4,939,547 A * 7/1990 Miyaji et al. ..... 399/228
5,057,876 A * 10/1991 Ohno ..... 399/184
6,122,470 A * 9/2000 Kimura ..... 399/227
6,198,893 B1 * 3/2001 Ichikawa et al. ..... 399/223
6,285,841 B1 * 9/2001 Miho ..... 399/55
7,167,669 B2 * 1/2007 Murata et al. ..... 399/277
7,391,995 B2 * 6/2008 Fujioka ..... 399/227

FOREIGN PATENT DOCUMENTS

JP 09190039 A * 7/1997
JP 2000242057 A * 9/2000

* cited by examiner

*Primary Examiner*—Robert Beatty
(74) *Attorney, Agent, or Firm*—Finnegan, Henderson, Farabow, Garrett & Dunner, L.L.P.

(57) ABSTRACT

In a color image forming apparatus comprising a plurality of developing devices each provided with a developing roller structured with a developing sleeve and a fixed magnetic pole member, an agitating member, a recovering and feeding member, a regulating member and a developing device casing member, at least one of the plurality of developing devices has a different developer storing capacity and a different outer diameter of the recovering and feeding member for the other developing devices and has the same angle allocation values among the plurality of fixed magnetic poles in the fixed magnetic pole member.

16 Claims, 11 Drawing Sheets

COLOR IMAGE FORMING APPARATUS HAVING DEVELOPING DEVICES WITH DIFFERENT STORAGE CAPACITIES

This application is based on Japanese Patent Application No. 2007-036053 filed on Feb. 16, 2007, in Japanese Patent Office, the entire content of which is hereby incorporated by reference.

BACKGROUND OF THE INVENTION

The present invention relates to an image forming apparatus, such as a copying machine, a printer, a facsimile, or an image forming apparatus which has a compound function, especially relates to a color image forming apparatus using developer including toner and carrier and equipped with a plurality of developing devices and to a process cartridge with quipped thereto.

Although colorization is progressing also in an image forming apparatus in recent years, when color image forming methods having high practicability are classified roughly, there may be four types, such as a transfer drum type, an intermediate transfer type, a KNC type (plural development one-time transfer type) and a tandem type, as a name often used.

Since the names of these types are named from a certain viewpoint, for example, there may be a method with both of the tandem type and the intermediate transfer type and there may be a method which directly transfers to a transfer material. Among these types, in the tandem type, that is, in a color image forming apparatus which forms each color image with a plurality of image forming units provided to each color and transfers each color one by one, kinds of available transfer material are too many, the quality of full color is very high and the full color can be obtained with high-speed. Especially, the special feature that the full color image can be obtained with high-speed is an advantage which is not seen in other types.

Moreover, although developer includes one component type developer and two component type developer, since the one component type developer does not need carrier, there is a merit that the cost of developer or a developing device can be made low. On the other hand, the two component type developer has a stable charging property of a toner, can obtain a high quality image, and is suitable also for a high-speed machine.

Furthermore, a smaller color image forming apparatus is requested due to the popularization of the color image forming apparatus, and in the color image forming apparatus using a plurality of developing devices, such as a tandem type, it is necessary to miniaturize each developing device more.

On the other hand, if the status of use of such a high-speed full color machine is taken into consideration, the colorization rate for a printing manuscript is not necessarily high and the machine is usually used only for a black printing manuscript in many cases. Therefore, there is a demand to increase the developer storage capacity of a developing device which stores a black developer.

In order to increase the black developer storage capacity, there is disclosed a color image forming apparatus having a structure in which a developing device which stores a black developer is made larger than developing devices which store developer of other colors (for example, refer to Japanese Patent Unexamined Publication Nos. 2001-183886 and 2001-75327).

The schematic diagram showing one example of a conventional color image forming apparatus shown in FIG. 14 is a schematic diagram of the color image forming apparatus disclosed by Japanese Patent Unexamined Publication No. 2001-183886, and the schematic diagram showing one example of a conventional color image forming apparatus shown in FIG. 15 is a schematic diagram of the color image forming apparatus disclosed by Japanese Patent Unexamined Publication No. 2001-75327.

In the color image forming apparatus disclosed by Japanese Patent Unexamined Publication No. 2001-183886 and shown in FIG. 14, our sorts of image forming stations are arranged side by side on a transfer belt arranged horizontally, and each image forming station is constituted with a photoreceptor drum, a charging device, a light exposing device, a developing device, and a cleaning means. The developing device has a structure in which a developing sleeve which includes a magnet roller therein, a RS roller (recovering and supplying member) which supplies a two component type developer to the developing sleeve and recoveries the developer and a toner feed member which agitates the developer are arranged side by side in a transverse direction. The developing device which stores a black developer is structured such that its size in the transverse direction is extended to longer than that of developing device of other colors and a toner supplying member is added in the extended space.

Namely, in the structure disclosed by Japanese Patent Unexamined Publication No. 2001-183886, four image forming stations are horizontally arranged side by side, and the developing device which stores the black developer and is arranged at the right end in FIG. 14 is constituted such that a new toner feed member is added in the transverse direction with the increase in a developer storing amount. Therefore, the developing device which stores a black developer becomes still more longer in the transverse direction, the whole image forming apparatus becomes longer and extremely large in the transverse direction, and it becomes difficult to attain the miniaturization of the whole image forming apparatus.

On the other hand, the color image forming apparatus disclosed by Japanese Patent Unexamined Publication No. 2001-75327 and shown in FIG. 15, [with three rollers] image forming stations are arranged side by side on an intermediate transfer belt which is arranged in three directions of vertical, horizontal and diagonal directions with three rollers. That is, three color image forming units (hereafter, merely refer as color unit) are arranged in the vertical direction, and a black image forming unit (hereafter, merely refer as a black unit) is arranged in the horizontal direction. By having arranged the black module independently, it has the feature that it makes easy to separate the color module from the intermediate transfer belt at the time of forming a black image and it can make the size of the developing device of a black unit larger while attaining the miniaturization of the image forming apparatus.

However, in the structure disclosed by Japanese Patent Unexamined Publication No. 2001-75327, the arranging position and the size of the developing device of the black unit are structured different from those of the color unit. Therefore, the magnetic pole arrangement of a developing roller and the structure of members in association with conveyance to supply developer to a developing roller or to recover developer have to be changed. It is Because the positional relationship of a developing pole in fixed magnetic poles of the developing roller positioned opposite to a photoreceptor drum is different between the developing device of the black unit and the developing device of the color unit, so the arrangements of an agitating roller to agitate developer and a feed roller to supply developer to the developing roller may change in connection with it.

Moreover, even if the developing device of a black unit and the developing device of a color unit are arranged in one line in a longitudinal direction, as far as the size of the developing device of the black unit is changed, the structure of members in association with conveyance of developer must be changed. Because, in order to increase the developer storing amount of the developing device of the black unit, it is necessary to enlarge the size of a developing device casing member. Further, in order to compensate shortage in abilities to agitate, convey and feed developer in connection with it, it is necessary to enlarge the size of an agitating roller or a feed roller. Even if the positional relationship between a photoreceptor drum and a developing roller is identically set among the developing devices of the black unit and the color unit, if the size of these rollers is enlarged, the conveyance passage or developer will change and in turn, the flow of conveyance and feed will change. Therefore, it is forced to change the arrangement of the fixed magnetic pole of the developing roller.

Furthermore, it may be predicted that a difference may arise in the changing way of the density level of an output image due to the difference in feeding and recovering actions for developer among the developing devices of the black unit and the color unit.

Therefore, there may be concern about the occurrence of the problem that the manufacturing cost of the members increases or the correction control method for improving the image quality in terms of the density level and the hue of an output image becomes complicated.

SUMMARY OF THE INVENTION

In order to solve the above problems, an object of the present invention is to provide a color image forming apparatus comprising a developing device and a process cartridge attached thereto in which with simple structures, a developing device to store color developer is structured such that flows of supplying and recovering developer on a developing roller are not changed while a storing amount of a developing device to store black developer is enlarged, and these developing devices allow to make the entire size of the apparatus small.

The above object can be attained with the following structures to which one aspect of the present invention is reflected.

(1) A color image forming apparatus, comprising:

a plurality of developing devices;

each of the plurality of developing devices having:

a developing roller including a cylindrical developing sleeve arranged at a position opposite to an image bearing member, supported to be rotatable, to carry developer including toner and carrier, to convey the developer to the image bearing member, and a fixed magnetic pole member arranged inside the developing sleeve and including a plurality of fixed magnetic poles formed in a peripheral direction;

an agitating member to agitate developer;

a recovering and feeding member supported to be rotatable, to feed developer to the developing roller and to recover developer scraped from the developing roller;

a regulating member to regulate an amount of developer fed to the developing roller; and a developing device casing member to store developer therein and to accommodate the developing roller, the regulating member, the agitating member and the recovering and feeding member therein;

wherein at least one of the plurality of developing devices has a different developer storing capacity and a different outer diameter of the recovering and feeding member for the other developing devices and has the same angle allocation values among the plurality of fixed magnetic poles in the fixed magnetic pole member.

(2) A color image forming apparatus, comprising:

a plurality of developing devices;

each of the plurality of developing devices having:

a developing roller including a cylindrical developing sleeve arranged at a position opposite to an image bearing member, supported to be rotatable, to carry developer including toner and carrier, to convey the developer to the image bearing member, and a fixed magnetic pole member arranged inside the developing sleeve and including a plurality of fixed magnetic poles formed in a peripheral direction;

an agitating member to agitate developer;

a recovering and feeding member supported to be rotatable, to feed developer to the developing roller and to recover developer scraped from the developing roller;

a regulating member to regulate an amount of developer fed to the developing roller; and a developing device casing member to store developer therein and to accommodate the developing roller, the regulating member, the agitating member and the recovering and feeding member therein;

wherein at least one of the plurality of developing devices has a different developer storing capacity and a different outer diameter of the recovering and feeding member for the other developing devices and has the same angle allocation values among the following three straight lines:

a straight line connecting the rotation center of the developing roller with the rotation center of the image bearing member, a straight line connecting the rotation center of the developing roller with the rotation center of the recovering and feeding member, and a straight line connecting the rotation center of the developing roller with a tip end of the regulating member.

DETAILED DESCRIPTION OF THE PREFERRED EMBODIMENT

Hereinafter, preferable embodiments of the present invention are explained, however, the present invention is not limited to these preferable embodiments.

First Embodiment

Figure 1:
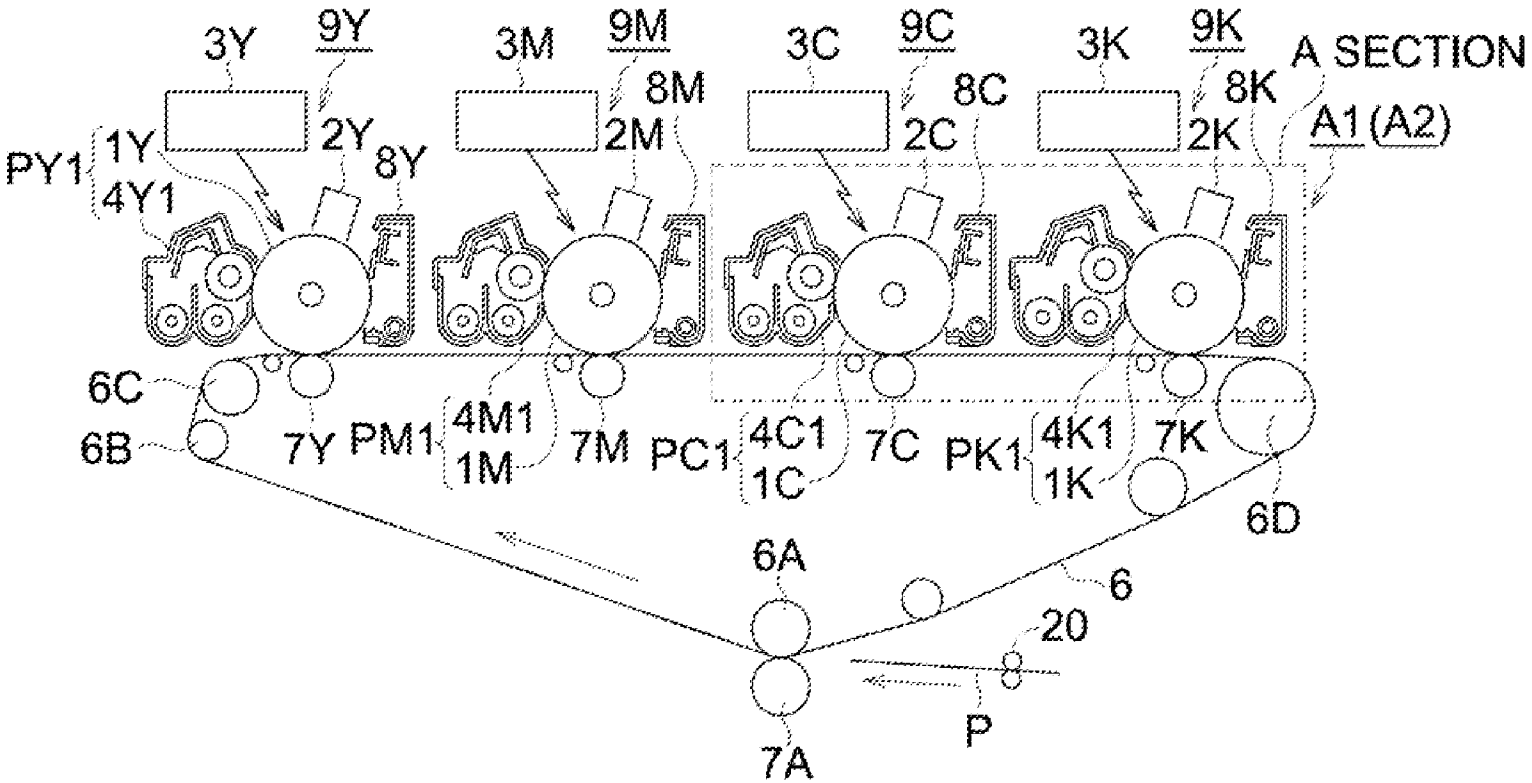
FIG. 1 is an outline schematic diagram showing the first embodiment of a color image forming apparatus according to the present invention.

FIG. 1 is an outline schematic diagram showing the color image forming apparatus A1 as the first embodiment of the color image forming apparatus according to the present invention.

The color image forming apparatus A1 has the structure in which image forming units are arranged in the transverse direction.

The color image forming apparatus A1 is called the tandem type color image forming apparatus and is structured with plural sets of image forming units 9Y, 9M, 9C, and 9K, a belt-like intermediate transfer member 6, and a sheet conveying device and a fixing device that are not illustrated.

Since the belt-like intermediate transfer member 6 is arranged horizontally and the plural sets of image forming units 9Y, 9M, 9C, and 9K are arranged side by side in the transverse direction in the color image forming apparatus A1, the length of the transverse direction of the color image forming apparatus A1 becomes longer. As a counter measure for this, in the developing device 4Y1, 4M1, 4C1, and 4K1 of the color image forming apparatus A1, the location of a developing roller is made higher to be above a recovering and supplying member so that the whole size of the devices is made longer in a longitudinal direction and the size of a transverse direction may become small.

An image forming unit 9Y to form an image of yellow color has a charging means 2Y, a light exposing means 3Y, a developing device 4Y1, a transferring means 7Y, and a cleaning means 8Y which are arranged around an image bearing member 1Y (hereafter, called as a photoreceptor). An image forming unit 9M to form an image of magenta color has a photoreceptor 1M, a charging means 2M, a light exposing means 3M, a developing device 4M1, a transferring means 7M, and a cleaning means 8M. An image forming unit 9C to form an image of cyan color has a photoreceptor 1C, a charging means 2C, a light exposing means 3C, a developing device 4C1, a transferring means 7C, and a cleaning means 8C. An image forming unit 9K to form a black image has a photoreceptor 1K, a charging means 2K, a light exposing means 3K, and a developing device 4K1, a transferring means 7K, and a cleaning means 8K. Therefore, the photoreceptors 1Y, 1M, 1C, and 1K are structured opposite to the developing device 4Y1, 4M1, 4C1 and 4K1 with the relationship of one to one.

The intermediate transfer member 6 is stretched around a plurality of rollers 6A, 6B, 6C, and 6D and is supported rotatable by the rollers.

An image of each color formed by the image forming units 9Y, 9M, 9C, and 9K is transferred one by one onto the rotating intermediate transfer member 6 by the transferring means 7Y, 7M, 7C, and 7K (primary transfer) so that a synthesized color image is formed. A transfer material P accommodated in a sheet cassette which is not illustrated is fed out from the sheet cassette by a sheet feeding means which is not illustrated and is conveyed to a transferring means 7A through a resist roller 20, and then a color image is transferred on the transfer material P by the transferring means 7A (secondary transfer). The transfer material P on which the color image was transferred is subjected to a fixing treatment by a fixing device which is not illustrated, is held between paper ejecting rollers which is not illustrate, and placed on a delivery tray which is located outside the machine and is not illustrated.

On the other hand, after a color image is transferred onto the transfer material P by the transferring means 7A, remaining toner on the intermediate transfer member 6 from which the transfer material P is separated is removed by a cleaning means which is not illustrated.

Process cartridge PY1, PM1, PC1, and PK1 according to the embodiment of the present invention are constituted integrally respectively by the photoreceptors 1Y, 1M, 1C, and 1K and the developing device 4Y1, 4M1, 4C1 and 4K1 corresponding to them and are arranged to be freely attached to or detached from the color image forming apparatus A1. By constituting the photoreceptors 1Y, 1M, 1C, and 1K and the developing device 4Y1, 4M1, 4C1 and 4K1 corresponding to them in one body respectively, it becomes possible to reduce adjustment works in the post process at the time of manufacturing the color image forming apparatus A1.

As another embodiment of the process cartridge PY1, PM1, PC1, and PK1, it is also possible to constitute the charging means 2Y, 2M, 2C, and 2K or the cleaning means 8Y, 8M, 8C, and 8K in one body in addition to the above-mentioned photoreceptors and the developing devices.

The Color Developing Device 4Y1, 4M1, and 4C1 Used for the First Embodiment

Figure 2:
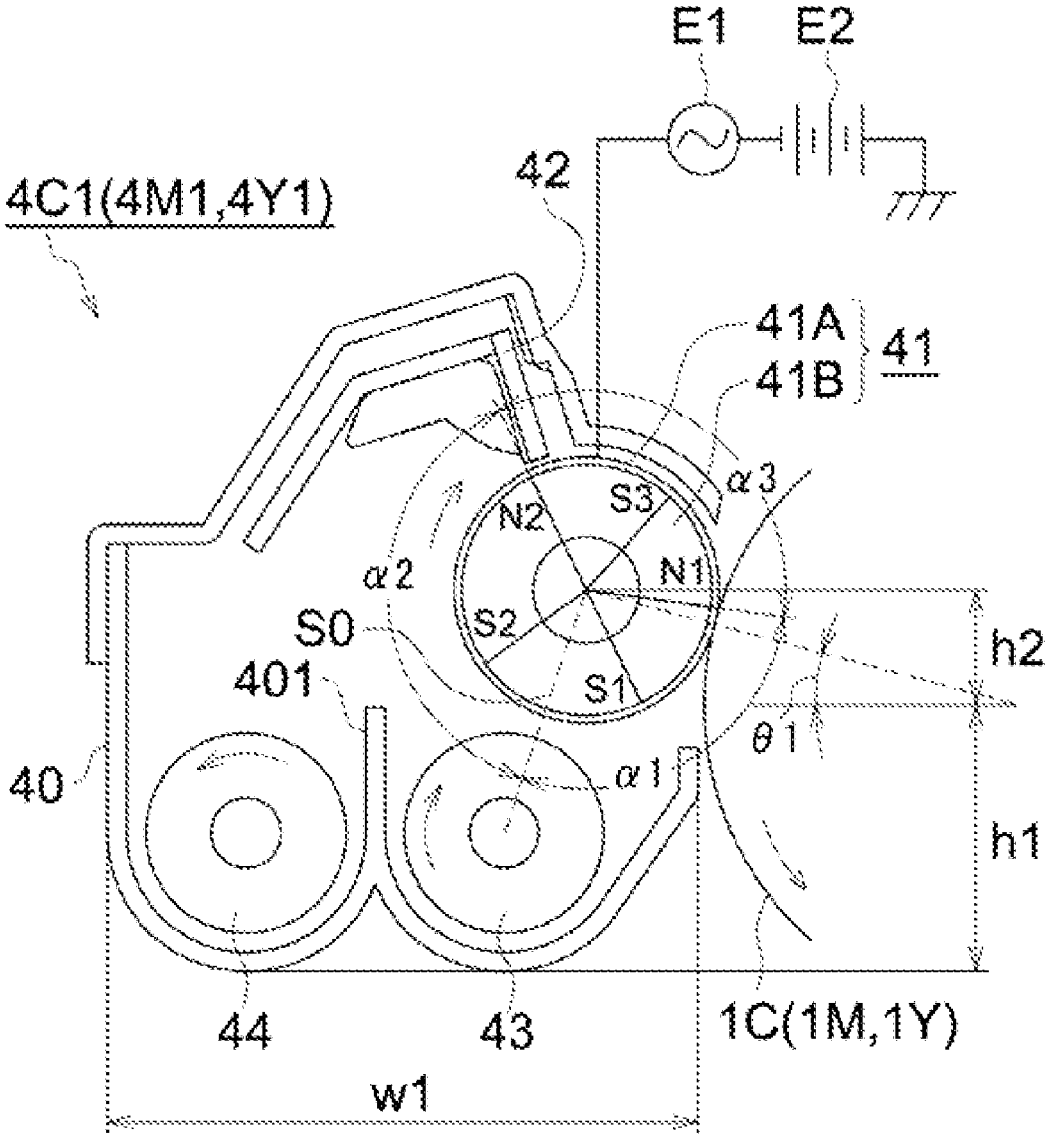
FIG. 2 is a sectional view for explaining the structure about a color developing device used for the color image forming apparatus A1 of the first embodiment of the present invention.
Figure 4:
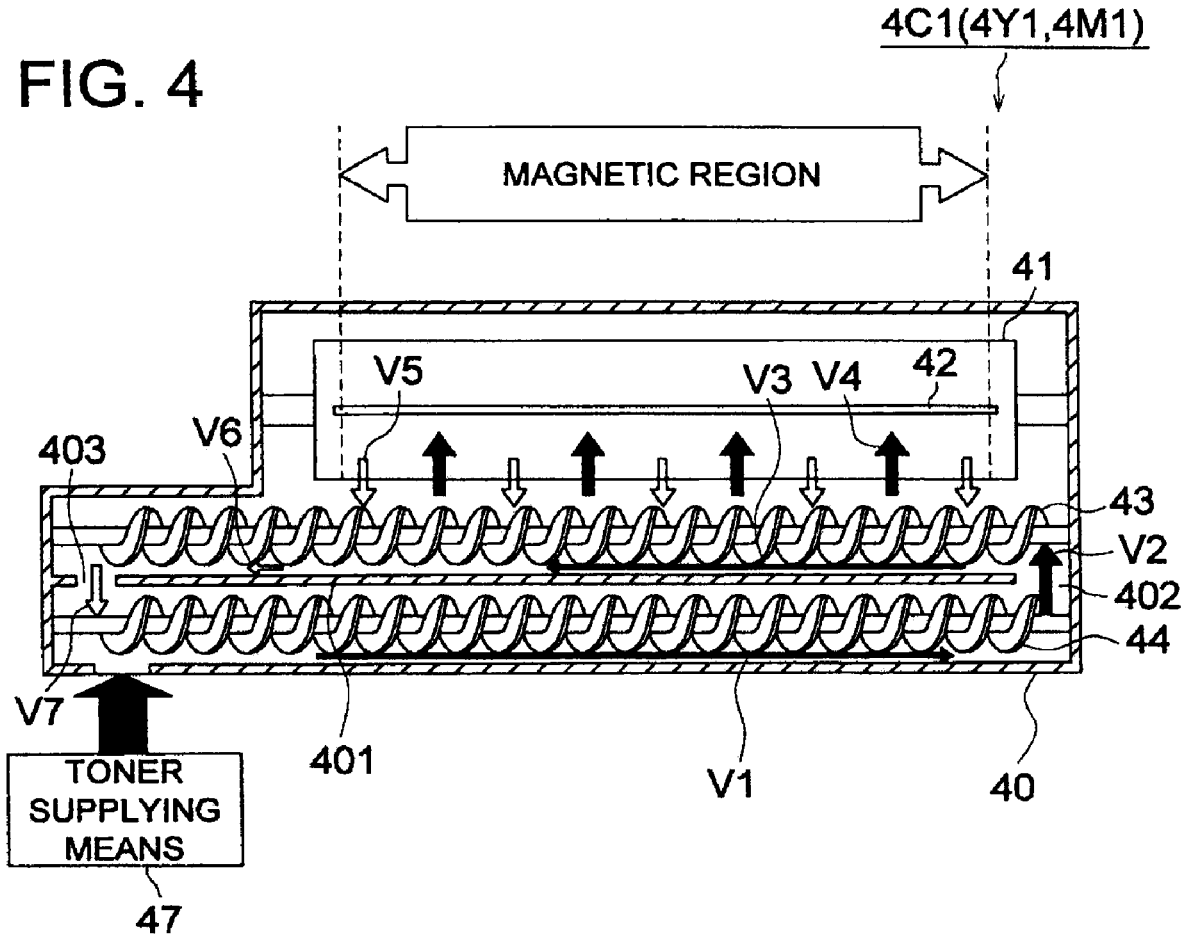
FIG. 4 is a plan view of a lower section mechanism of color developing devices 4C1, 4Y1 and 4M1 used for the color image forming apparatus A1 of the first embodiment of the present invention.
Figure 5:
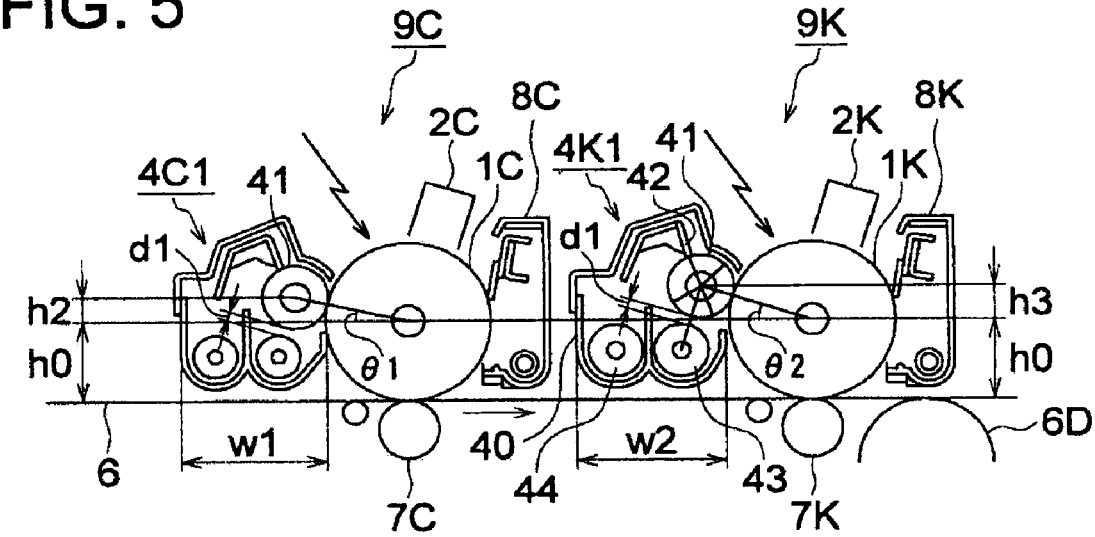
FIG. 5 is an enlarged view of an A section in FIG. 1 and an outline view for explaining a difference in structure between the color developing device 4C1 and the black developing device 4K1.

FIG. 2 is a sectional view for explaining the structure of the developing devices 4Y1, 4M1, and 4C1 for colors (hereinafter, merely referred, as color developing devices) used for the color image forming apparatus A1 of the first embodiment according to the present invention. FIG. 4 is a plan view of the lower section mechanism of the color developing devices 4Y1, 4M1, and 4C1. FIG. 5 is an enlarged view of an A section in FIG. 1 and is a schematic diagram for explaining a difference in structure among the color developing device 4C1 and a developing device 4K1 for black (hereinafter, merely referred as black developing devices).

In FIG. 2, the structure in the embodiment of the color developing device 4Y1, 4M1, and 4C1 is a structure suitable to be used for the color image forming apparatus A1 in which the intermediate transfer member 6 is arranged horizontally, and the size of the structure is made small in a transverse direction.

Since three color developing devices 4Y1, 4M1, and 4C1 in this embodiment are made with the same structure, the structure of the developing device 4C1 of a cyan color is explained as a representative of them. Although the difference in structure between the color developing device 4C1 and the black developing device 4K1 (after-mentioned) is later mentioned with reference to FIGS. 3 and 5, the storage capacity of developer in the black developing device 4K1 is constituted to become larger than the color developing device 4C1.

The color developing device 4C1 is structured with a developing device casing member 40, a developing roller 41, a regulating member 42, a recovering and supplying member 43 (hereafter, called as a recovering and feeding screw), and an agitating member 44 (hereafter, called as an agitating screw). The developing roller 41 is structured with a developing sleeve 41A and a fixed magnetic pole member 41B.

At the proximity point in the opposite space between the developing sleeve 41A and the recovering and feeding screw 43, the developing sleeve 41A is rotated from the lower part to the upper part, the recovering and feeding screw 43 is rotated from the upper part to the lower part, and a regulating member 42 is arranged near a regulating pole N2 (after-mentioned) of the fixed magnetic pole member 41B.

The developing device casing member 40 is structured with a case body having a width dimension w1, supports the developing roller 41, the recovering and feeding screw 43, and the agitating screw 44 to be rotatable freely inside thereof, and holds the regulating member 42. The recovering and feeding screw 43 and the agitating screw 44 are arranged separately at both sides a partition plate 401 (refer to FIG. 4) which stands straight from the bottom of the developing device casing member 40 so as to sandwich the partition plate therebetween.

The developing roller 41 is structured with the developing sleeve 41A and the fixed magnetic pole member 41B, is arranged opposite to the photoreceptor 1 which bears an electrostatic latent image on its surface, and is further arranged such that the rotation center of the developing roller 41 is located at the position with an elevation angle θ1 from the rotation center of the photoreceptor 1. Here, the elevation angle means an angle formed between a line which extends from the rotation center of the photoreceptor 1 to the rotation center of the developing roller 41 and a horizontal line passing along the rotation center of the photoreceptor 1.

By arranging the developing roller 41 above the recovering and feeding screw 43, the structure with the arrangement prevents an increment in the width dimension w1 of the developing device casing member 40, prevents an increment in the dimension of the transverse direction of the color developing device 4Y1, 4M1, and 4C1, and prevents an increment in dimension of the transverse direction of the color image forming apparatus A1.

The developing sleeve 41A is applied with a developing bias in which an alternating voltage by an AC power source E1 and a direct current voltage by a DC power source E2 are superimposed.

The fixed magnetic pole member 41B is arranged to be fixed inside the developing sleeve 41A and has five poles N1, N2, S1, S2, and S3.

The pole N1 is a developing pole and the pole N2 is a regulating pole. A scraping pole S1 as the first repelling pole and a scooping pole S2 as the second repelling pole are adjacent to each other and have the same polarity, and a repelling pole S0 is formed by the two poles S1 and S2. The scraping pole S1 is formed in the upstream of the developing-roller 41 in terms of the rotation direction, and the scooping pole S2 is formed in the downstream. A pole S3 is a conveyance pole.

Three color developing devices 4Y1, M1 and 4C1 used for the first embodiment of the present invention comprise respective fixed magnetic pole members 41B and the respective fixed magnetic pole members 41B are structured such that an angle allocation value among respective fixed magnetic poles is the same.

Five magnetic poles of the fixed magnetic pole member 41B are arranged a developing pole N1, a scraping pole S1, a scooping pole S2, a regulating pole N2, and a conveyance pole S3 in this order in the rotation direction of the developing roller 41.

The fixed magnetic pole member 41B is attached to the developing device casing member 40 at an angle in which the center of the line of magnetic force of the developing pole N1 goes to a developing area formed on the photoreceptor 1.

In this embodiment, the fixed magnetic pole member 41B is attached to the developing device casing member 40 such that the developing pole N1 has an angle of about 4 degrees inclined to the upstream side in the rotation direction of the photoreceptor 1 from the straight line which proceeds with the elevation angle θ1 from the rotation center of a photoreceptor 1 to the rotation center of the developing roller 41.

The line of magnetic force of the repelling pole S0 is formed with an angle to proceed from the fixed magnetic pole member 41B to near the rotation center of the recovering and feeding screw 43. The line of magnetic force of the regulating pole N2 is formed with an angle to proceed from the fixed magnetic pole member 41B to the leading end of the regulating member 42.

The scraping pole S1 is a pole to scrape developer and scrape and drops developer off from the developing sleeve 41A. The scooping pole S2 is used for receiving developer and scoops developer supplied by the recovering and feeding screw 43 and makes the developer to adhere on the developing sleeve 41A.

The angle α1 formed by the developing pole N1 and the repelling pole S0 and the angle α2 formed by the repelling pole S0 and the regulating pole N2 are the same among the three color developing devices 4Y1, 4M1, and 4C1 and are especially an important include angle having an influence for the conveying performance of the developer in the developing device 4A1.

The recovering and feeding screw 43 agitates and conveys developer conveyed from the agitating screw 44, and supplies it to the developing roller 41 uniformly. Each of the recovering and feeding screw 43 and the agitating screw 44 is a screw members spirally formed.

The agitating screw 44 is arranged in parallel to the recovering and feeding screw 43, mixes and agitates new toner supplied from a toner replenishment means which is not illustrated and developer which flows back through the recovering and feeding screw 43 from the developing sleeve 41A, and conveys the mixed developer to the upper part of the recovering and feeding screw 43.

The recovering and feeding screw 43 supplies developer towards the developing roller 41 while conveying a developer along its rotating shaft, recovers from the developing roller 41 developer which finished development, and sends the developer into the agitating screw 44.

The regulating member 42 is structured with a magnetic substance, and serves as a scooping pole.

The action of circulation of developer in the color developing device 4C1 is explained hereafter with reference to FIG. 4.

(1) Developer which flows back through the recovering and feeding screw 43 from the developing roller 41 and new toner supplied from a toner replenishment means which is not illustrated are conveyed towards the agitating screw 44. The conveyed developer is agitated and mixed by the agitating screw 44 and is conveyed in the developer shifting direction shown by an arrow mark V1.

(2) The mixed developer passes through a first opening section 402 formed at the downstream side of the agitating screw 44, is conveyed in the direction shown by an arrow mark V2, and is introduced into the upstream side of the developer shifting direction in the recovering and feeding screw 43. The introduced developer is conveyed in the developer shifting direction shown by an arrow mark V3 while being agitated by the recovering and feeding screw 43.

(3) Conveying developer in the direction shown by the arrow mark V3, the recovering and feeding screw 43 discharges the developer in the direction shown in the arrow mark V4, and supplies the developer onto the developing roller 41.

(4) In a developing region at which the developing roller 41 and the photoreceptor drum 1 oppose to each other, developer carried on the developing roller 41 is used for a development process. After the development process, the developer in which the toner concentration is lowered is conveyed by the developing sleeve 41A, and is scraped off from the developing roller 41 by the scraping pole S1 of the fixed magnetic pole member 41B.

(5) the scraped-off developer is shifted towards the direction shown in the arrow mark V5, and is conveyed by the recovering and feeding screw 43.

(6) The developer is conveyed in the direction shown in the arrow mark V6, passes through a second opening section 403 formed in the downstream side of the recovering and feeding screw 43, is conveyed by the recovering and feeding screw 43 in the direction shown in the arrow mark V7, and is introduced into upstream side of the developer shifting direction of the agitating screw 44.

(7) Based on a toner concentration detection signal from a toner concentration sensor which are arranged in the inside of the developing device casing member 40 and is not illustrated, replenishment of new toner is performed by a toner replenishment means which is not illustrated, the new toner and developer are mixed, and the mixture is conveyed in the direction indicated with an arrow mark V1.

Although developer is conveyed by the above circulating system, a part of developer is circulated through between the agitating screw 44 and the recovering and feeding screws 43, as shown in arrow marks V1, V2, V3, V6, and V7.

Black Developing Device 4K1 Used for the First Embodiment

Figure 3:
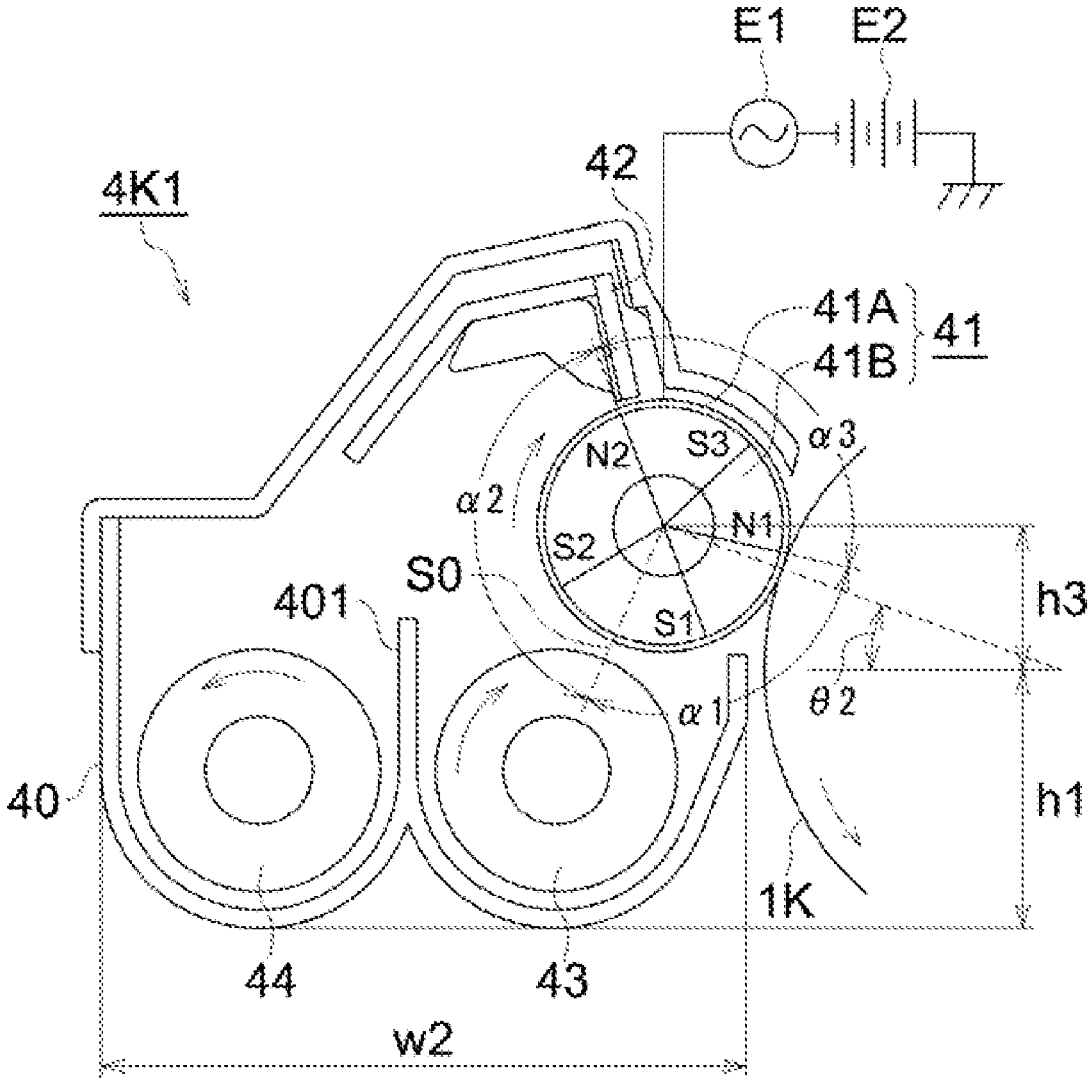
FIG. 3 is a sectional view for explaining the structure about a black developing device used for the color image forming apparatus A1 of the first embodiment of the present invention.

FIG. 3 is a sectional view for explaining the structure about a black developing device 4K1 used for the color image forming apparatus A1 of the first embodiment according to the present invention.

Since the structure of the black developing device 4K1 is similar to the structure of the color developing device 4C1 explained in FIG. 2 and the members which have the same functions are provided with the same reference number, detailed descriptions are omitted, and only parts having different structures are explained. Hereafter, differences in structures between the black developing device 4K1 and the color developing device 4C1 are mainly explained with reference to FIGS. 3 and 5.

In FIG. 5, the photoreceptors 1C (including 1Y, 1M) and the photoreceptor 1K have the same outside diameter, and are arranged to come in contact with the intermediate transfer member 6 which is extended horizontally. Therefore the center of the photoreceptor 1C and the center of the photoreceptor 1K are located on the same horizontal line, and arranged at a position having a height h0 from the intermediate transfer member 6.

In FIGS. 3 and 5, since black developing device 4K1 is structured so as to have a developer storage capacity larger than that of the color developing device 4C1, the size of the developing device casing member 40 is made larger. However, it may be difficult to enlarge the height h1 from the bottom of the developing device casing member 40 in the black developing device 4K1 to the center of the photoreceptor 1C, because the intermediate transfer member 6 is positioned near the bottom of the developing device casing member 40. Therefore, it is made the same value as the above-mentioned height h1 of the color developing device 4C1, and the width dimension w2 of the developing device casing member 40 is enlarged. On the other hand, the photoreceptor 1C (including 1Y, 1M) and the photoreceptor 1K have the same outside diameter, and are arranged to come in contact with the intermediate transfer member 6 which is extended horizontally. Therefore the center of the photoreceptor 1C and the center of the photoreceptor 1K are located on the same horizontal line (a height h0).

Next, with reference to FIG. 5, the positional relationship among the black developing device 4K1 and the color developing device 4C1 in the image forming units 9C and 9K according to this embodiment, and a difference in structure between the black developing device 4K1 and the color developing device 4C1 are explained.

In this embodiment, in order to make a developer storing amount of the black developing device 4K1 larger than that of the color developing device 4C1 (including 4Y1, 4M1), the size of the width direction of the developing device casing member 40, the outside diameter size of the recovering and supplying member 43 and the agitating screw 44 are changed.

That is, the width dimension w2 of the developing device casing member 40 of the black developing device 4K1 is made larger than the width dimension w1 of the color developing device 4C1 (including 4Y1, 4M1). Moreover, in order to prevent the performance decrement in agitating, conveying, feeding and recovering developer in connection with an increment of the width dimension w2 of the black developing device 4K1, the outside diameter size of the agitating screw 44 and the recovering and feeding screw 43 in the black developing device 4K1 is enlarged.

In the black developing device 4K1, by enlarging the outside diameter size of the agitating screw 44 and the recovering and feeding screw 43, the height of the rotation center of the developing roller 41 becomes high. That is, the height h3 from the rotation center of the photoreceptor 1K to the rotation center of the developing roller 41 in the developing device 4K1 becomes higher than the height h2 of the rotation center of the developing roller 41 in the color developing device 4C1.

Moreover, the structure of black developing device 4K1 has an object of preventing an increment of the width dimension w2 of the developing device casing member 40 and also preventing an increment of the dimension of a transverse direction, by the arrangement that the developing roller 41 is located at the upper high position of the recovering and feeding screw 43 as same with the color developing device 4C1.

Here, the developing roller 41 in the black developing device 4K1 is located on a line with the elevation angle θ2 from the rotation center of the photoreceptor 1K to the horizontal line passing through the rotation center of the photoreceptor 1K, and similarly the rotation center of the developing roller 41 in the color developing device 4C1 is located on the line with the elevation angle θ1. At this time, since the height of the developing roller 41 in the black developing device 4K1 is higher than the height of the developing roller 41 in the color developing device 4C1, the elevation angle θ2 becomes a larger value than θ1.

In the four developing devices 4Y1, 4M1, 4C1, and 4K1 according to the embodiment of the present invention, the angle allocation value showing the angle allocation between a plurality of fixed magnetic poles in the fixed magnetic pole member 41B of the developing roller 41 is constituted so that all the four developing devices have as the same value. Especially, an angle α1 formed by the developing pole N1 and the repelling pole S0 and an angle α1 formed by the repelling pole S0 and the regulating pole N2 shown in FIGS. 2 and 3 are an important angle in securing a conveying performance for developer.

The developing pole N1 of the fixed magnetic pole member 41B is set at an angle with which the center of a line of magnetic force proceeds near the rotation center of the photoreceptor 1. For this reason, the mounting angle of the fixed magnetic pole member 41B in the peripheral direction to the developing device casing member 40 is attached at a different angle in correspondence with different elevation angles θ1 and θ2 in the black developing device 4K1 and the color developing device 4C1 (including 4Y1, 4M1).

According to the present invention, although there are differences in structure between the black developing device 4K1 and the color developing device 4C1, with the structure to makes an angle allocation value between fixed magnetic poles to be the same value, it can cause advantages that the performance of feeding and recovering developer does not change and the common image correction control can be performed.

In the black developing device 4K1 and the color developing device 4C1 according to the embodiment of the present invention, the outside diameter size of the developing sleeve 41A is set up identically. By making the outside diameter size of the developing sleeve 41A to be the same, the fixed magnetic pole member 41B also has the same size. Therefore, the standardization to make the common size becomes possible, and it can be contributed to the cutback of the manufacturing cost of the developing sleeve 41A and the fixed magnetic pole member 41B.

However, it is also possible to change the outside diameter size of the developing sleeve 41A between the black developing device 4K1 and the color developing device 4C1.

About the plan view of the lower section mechanism in the black developing device 4K1 and the action of circulating developer, since these are similar with those in the color developing device 4C1 explained in FIG. 4, descriptions for these are omitted.

Second Embodiment

The color image forming apparatus A2 of this embodiment is similar with the color image forming apparatus A1 of the first embodiment, and a difference is only the structure of a developing device. Therefore, the same figure (FIG. 1) is used. Since the structure and other actions of the color image forming apparatus A2 are the same as that of the color image forming apparatus A1, the descriptions about them are omitted and only the structure and the action of the developing device are explained below.

Color Developing Device 4Y2, 4M2, 4C2 Used for the Second Embodiment

Figure 6:
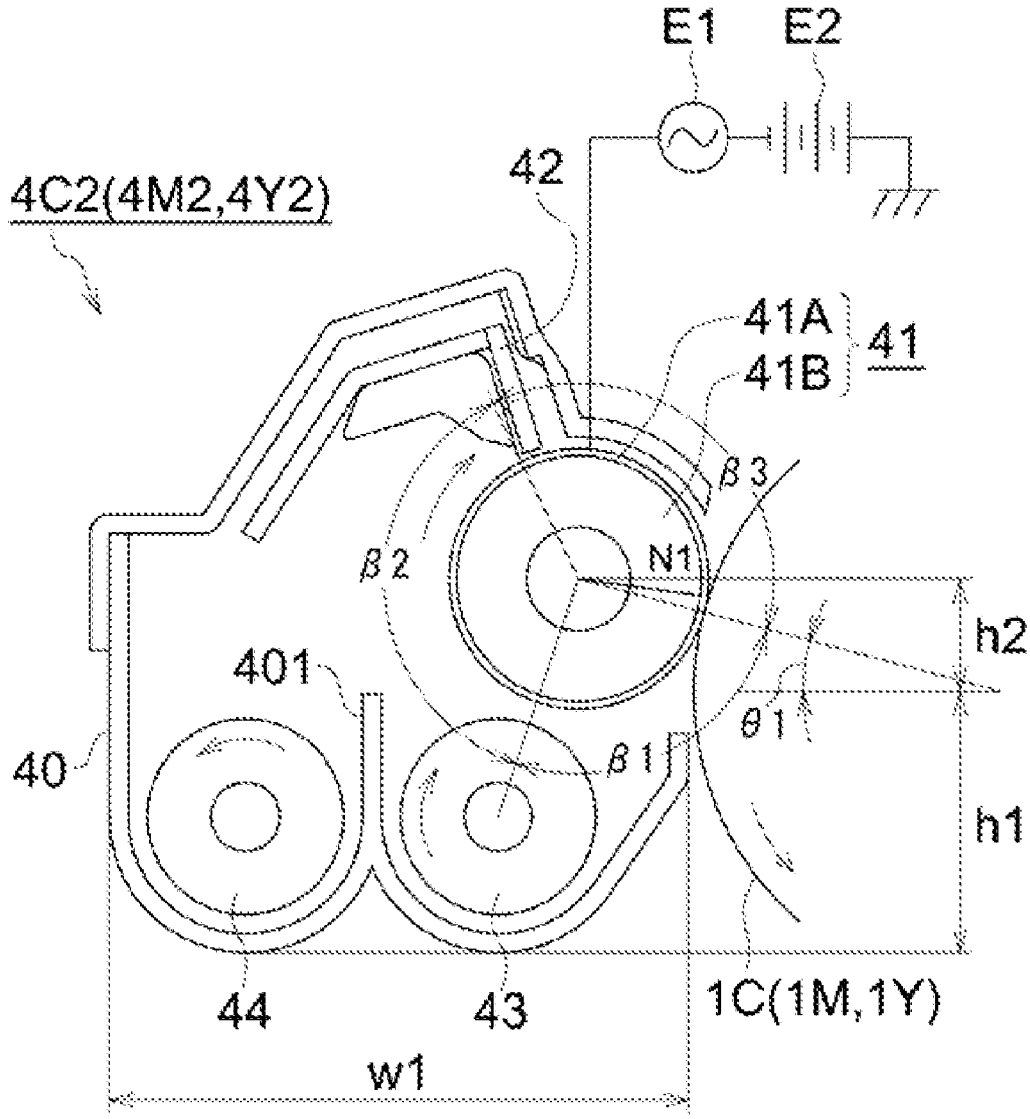
FIG. 6 is a sectional view for explaining the structure about a color developing device used for the color image forming apparatus A2 of the second embodiment of the present invention.

FIG. 6 is a sectional view for explaining the structure about the embodiment of the color developing device 4Y2 used for the color image forming apparatus A2 of the second embodiment according to the present invention.

Since three color developing devices 4Y2, 4M2, and 4C2 according to this embodiment have the same structure, the structure of the color developing device 4C2 shown in FIG. 6 is explained as the representative. The explanation about differences in structure between the color developing device 4C2 and the black developing device 4K2 is mentioned later with reference to FIGS. 6 to 8.

The color developing device 4C2 has a structure suitable for being used for the color image forming apparatus A2 which is the second embodiment of color image forming apparatus, and the size of the structure is made small in its transverse direction.

The structure of the color developing device 4C2 is similar to the structure of the color developing device 4C1 explained in FIG. 2, since the members which have the same functions are provided with the same reference number, detailed descriptions are omitted, and only parts having different structures are explained.

A constitutional different point between the color developing device 4C1 and the color developing device 4C2 is a difference between the point that the angle allocation values of the fixed magnetic poles are constituted with the same value and the point that the angle allocation values in arrangement of the constructing members are constituted with the same value. That is, the color developing devices 4C1 is constituted such that the angle allocation values in the fixed magnetic poles of the developing roller 41 are made with the same values, in contrast, the color developing devices 4C2 is constituted such that the angle allocation value in the arrangements of the constructing members are made with the same values.

In the three color developing devices 4C2, 4Y2, and 4M2, the position of the rotation centre of the photoreceptor 1C, the position of the rotation centre of the recovering and feeding screw 43, and the position of the leading end of the regulating member 42 are arranged around the developing roller 41 with the same angle allocation values on the basis of the rotation center of the developing roller 41.

Here, as shown in FIG. 6, the position of the rotation centre of the photoreceptor 1C, the position of the rotation centre of the recovering and feeding screw 43, and the position of the leading end of the regulating member 42 are connected with three straight lines respectively from the position of the rotation centre of the developing roller 41. An angle formed between the line passing the position of the rotation centre of the photoreceptor 1C and the line passing the position of the rotation centre of the recovering and feeding screw 43 is represented with β1 and an angle formed between the line passing the position of the rotation centre of the recovering and feeding screw 43 and the line passing the position of the leading end of the regulating member 42 is represented with β2. A remaining symbol β3 is an angle formed between the line passing the position of the rotation centre of the photoreceptor 1C and the line passing the position of the leading end of the regulating member 42. Therefore, in all of the three color developing devices 4C2, 4M2, and 4Y2, the angle allocation values in the arrangements of the three constructing members are represented with the same values of β1, β2, and β3. Especially, an angle β1 between the line passing the position of the rotation centre of the photoreceptor 1C and the line passing the position of the rotation centre of the recovering and feeding screw 43 and an angle β2 between the line passing the position of the rotation centre of the recovering and feeding screw 43 and the line passing the position of the leading end of the regulating member 42 are important angles in securing the conveying performance for developer.

In all of the color developing devices 4C2, 4M2, and 4Y2, flows of feeding and recovering developer can be made with the same performance by making the angle allocation values of the photoreceptor 1, the recovering and feeding screw 43 and the regulating member 42 around the developing roller 41 to be the same values.

Besides, since explanations about the plan view of the lower section mechanism of the color developing device 4C2 and the action of circulating developer are the same as those in the color developing device 4C1 of the first embodiment shown in FIG. 4, the explanations are omitted.

Black Developing Device 4K2 Used for the Second Embodiment

Next, the structure of the black developing device 4K2 used for the second embodiment is explained.

Figure 7:
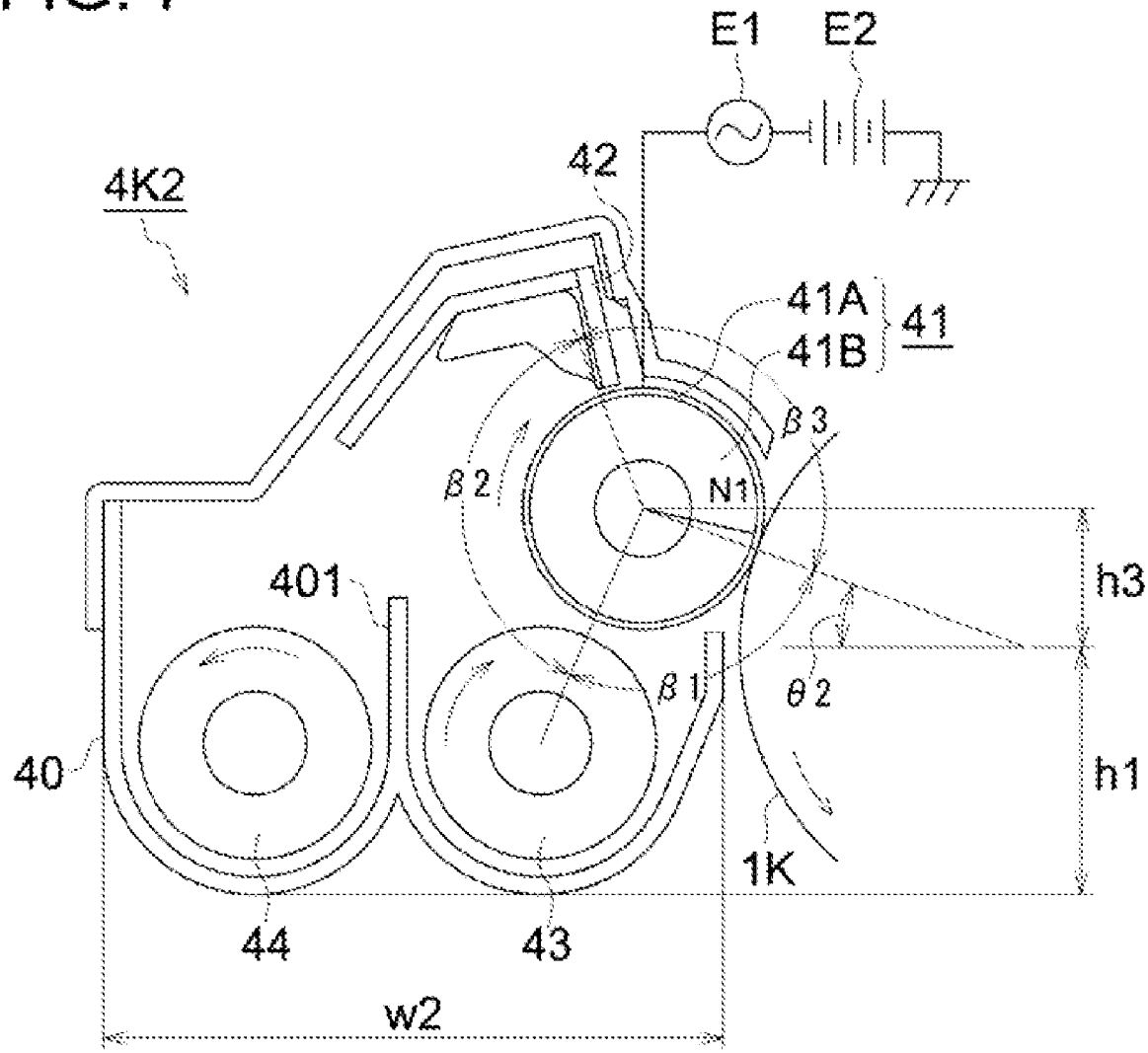
FIG. 7 is a sectional view for explaining the structure about a black developing device used for the color image forming apparatus A2 of the second embodiment of the present invention.

FIG. 7 is a sectional view for explaining the structure of the black developing device 4K2.

In FIG. 7, in order to make the developer storage capacity of the black developing device 4K2 larger than that of the color developing device 4C2, the black developing device 4K2 is constituted such that the size of the developing device casing member 40 becomes larger as same as that of the black developing device 4K1. That is, the width dimension w2 of the developing device casing member 40, the height h1 from the bottom position of the developing device casing member 40 to the center of the photoreceptor 1K, and the height h3 from the center of the photoreceptor 1K to the center of the developing roller 41 are the same value as those in the black developing device 4K1. Moreover, the elevation angle θ2 from the centre position of the developing roller 41 to the centre position of the photoreceptor 1C is also the same value.

The point that the black developing device 4K2 differs from the black developing device 4K1 is the same as the different point between the color developing device 4C1 and the color developing device 4C2.

That is, the different point is that the black developing device 4K1 is constituted so as to make the angle allocation values of the fixed magnetic poles to be the same values, in contrast, the black developing device 4K2 is constituted so as to make the angle allocation values in the arrangement of the constructing members to be the same values.

As same the color developing device 4C2, the black developing device 4K2 has the structure that three members of the photoreceptor 1C, the recovering and feeding screw 43 and the regulating member 42 are arranged around the developing roller 41 with the same angle allocation values on the basis of the rotation center of the developing roller 41. That is, if the arrangement of the three above-mentioned members is expressed with three straight lines as shown in FIG. 7, the angle allocation values between three straight lines become β1, β2, and β3. These angle allocation values are the same as those of the angle allocation values of the color developing device 4C2 explained in FIG. 6, whereby all of the four developing devices 4Y2, 4M2, 4C2, and 4K2 have the same values.

By constituting such that the angle allocation values of the photoreceptor 1, the recovering and feeding screw 43 and the regulating member 42 around the developing roller 41 are the same values in all the developing devices, it becomes possible to make flows of feeding and recovering developer to the developing roller 41 to be equivalent.

According to the present invention, even if there are differences in structure between the color developing device 4C2 and the black developing device 4K2, since the flows of feeding and recovering developer do not change with the structure that the angle allocation values between members are made the same values, there may arise the advantage that the common image correction control can be performed.

About the difference in structure between the black developing device 4K2 and the color developing device 4C2, since it is the same with the difference in structure between the black developing device 4K1 and the color developing device 4C1, an explanation about the difference is omitted.

Third Embodiment

Figure 8:
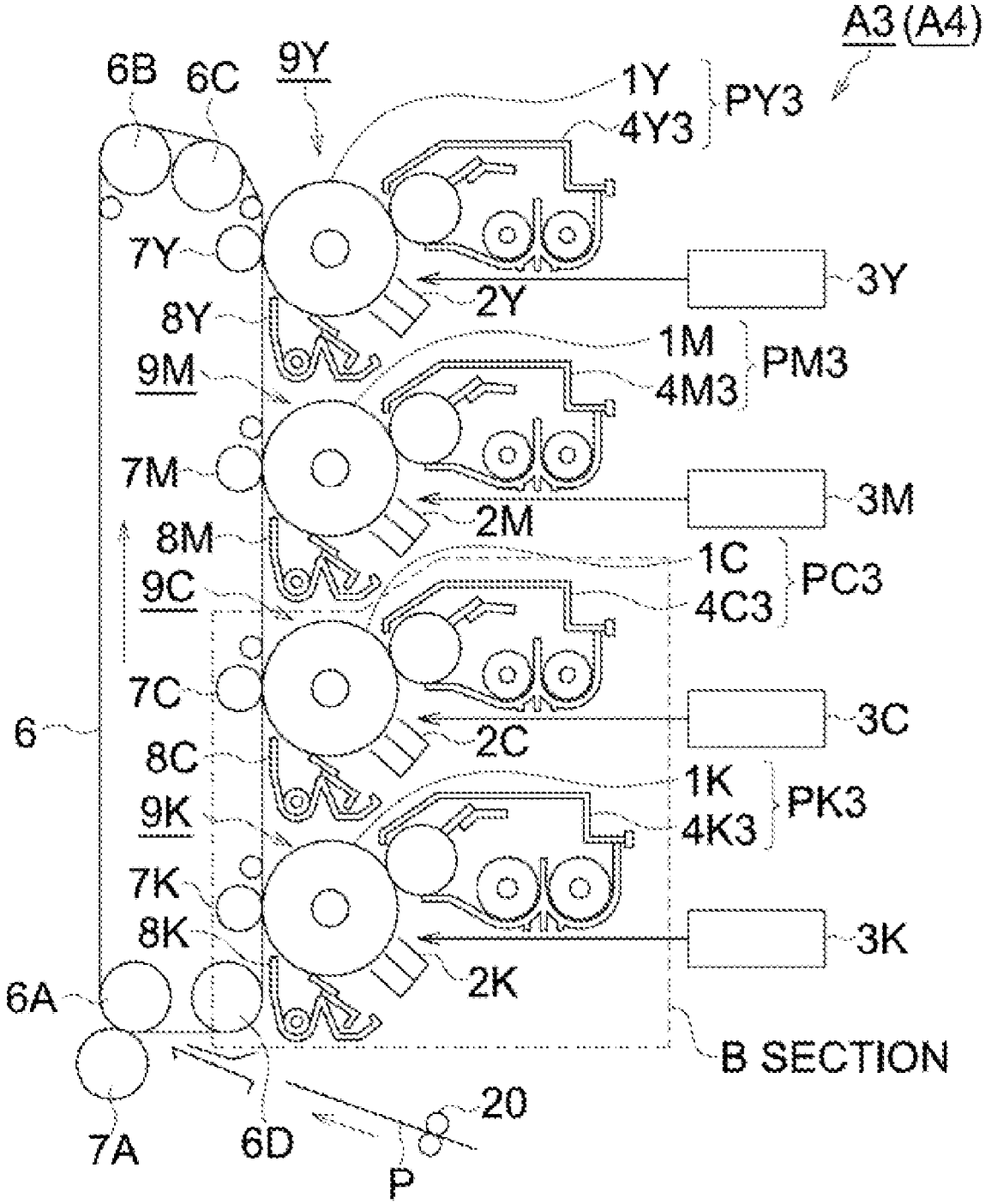
FIG. 8 is an outline schematic diagram showing the third embodiment of a color image forming apparatus according to the present invention.

FIG. 8 is an outline schematic diagram showing the color image forming apparatus A3 as the third embodiment.

The color image forming apparatus A3 is an color image forming apparatus capable of forming a color image and has the structure in which image forming units are arranged in the vertical direction.

The structure of the color image forming apparatus A3 is similar with the color image forming apparatus A1 of the first embodiment in which the image forming units are arranged in the transverse direction. Since the same reference number is given to members which construct the same structure, an explanation about the members is omitted, and only members which construct different structures will be explained.

Since the belt-like intermediate transfer member 6 is arranged vertically and the plural sets of image forming units 9Y, 9M, 9C, and 9K are arranged in the longitudinal direction in the color image forming apparatus A3, the length of the longitudinal direction of the color image forming apparatus A3 becomes longer. As a counter measure for this, in the developing device 4Y3, 4M3, 4C3, and 4K3 of the color image forming apparatus A3, the location of a developing roller is made lower and is arranged closer to the height of a recovering and supplying member 43 so that the whole size of the devices is made longer in the transverse direction and the size of the longitudinal direction may become small.

Process cartridge PY3, PM3, PC3, and PK3 according to the embodiment of the present invention are constituted integrally respectively by the photoreceptors 1Y, 1M, 1C, and 1K and the developing device 4Y3, 4M3, 4C3 and 4K3 corresponding to them and are arranged to be freely attached to or detached from the color image forming apparatus A3.

As another embodiment of the process cartridge PY3, PM3, PC3, and PK3, it is also possible to constitute the charging means 2Y, 2M, 2C, and 2K or the cleaning means 8Y, 8M, 8C, and 8K in one body in addition to the above-mentioned photoreceptors and the developing devices.

Moreover, the black developing device 4K3 according to this embodiment has the structure that the developer storage capacity is larger as compared with the color developing device 4Y3, 4M3, and 4C3, and the structure that the outside diameter size of the recovering and supplying member (aftermentioned) of the developing device is larger.

Figure 9:
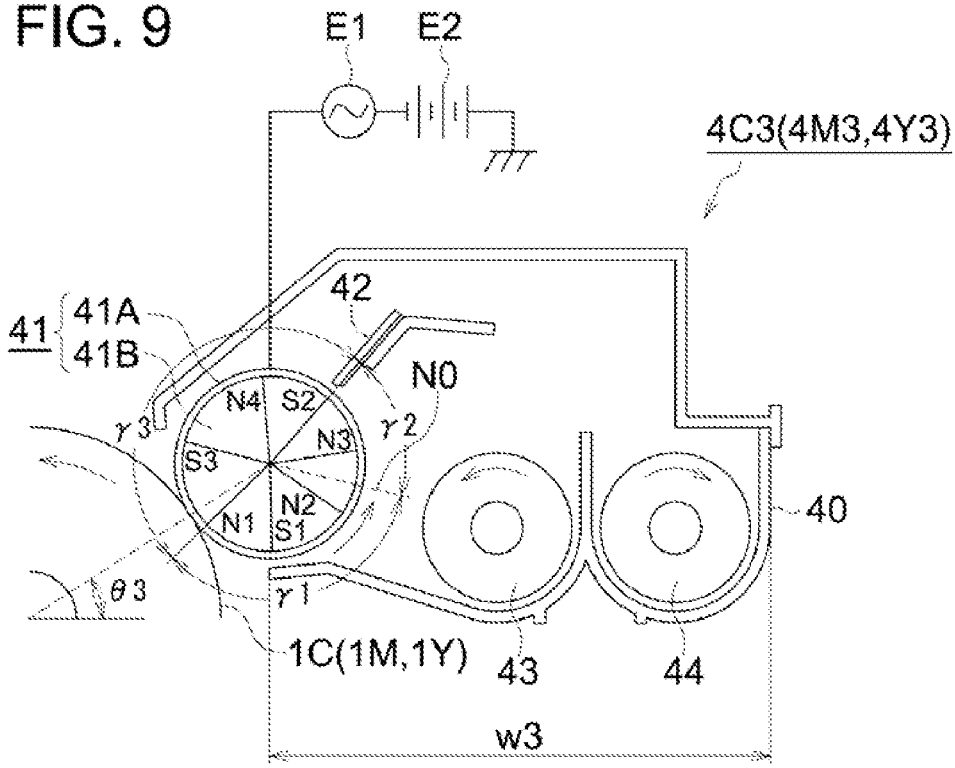
FIG. 9 is a sectional view for explaining the structure about a color developing device used for the color image forming apparatus A3 of the third embodiment of the present invention.
Figure 11:
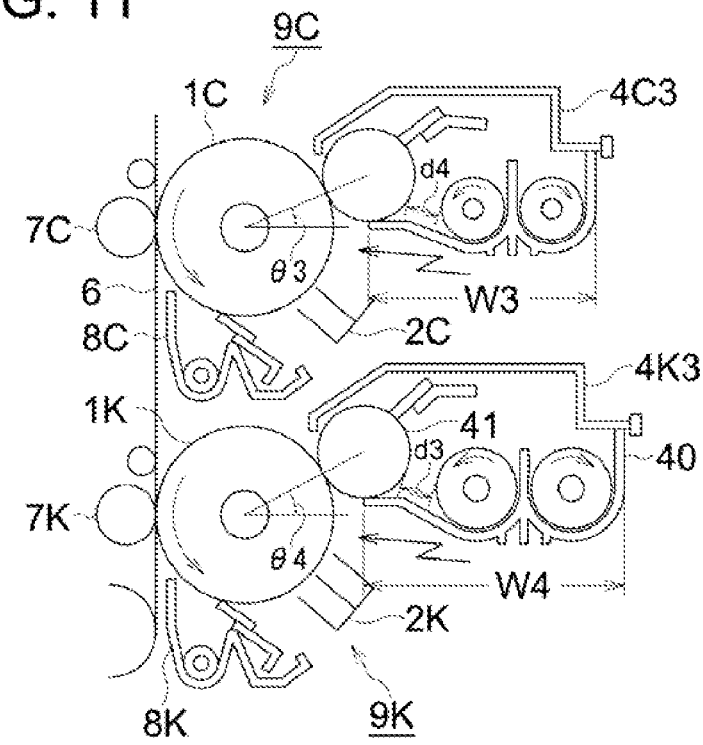
FIG. 11 is an enlarged view of a B section in FIG. 8 and a view for explaining a difference in structure between the color developing device 4C3 and the black developing device 4K3.

The Color Developing Device 4Y3, 4M3, and 4C3 Used for the Third Embodiment FIG. 9 is a sectional view for explaining the structure of the color developing devices 4Y3, 4M3, and 4C3 for colors used for the color image forming apparatus A3 of the third embodiment according to the present invention. FIG. 11 is an enlarged view of a B section in FIG. 8 and is a schematic diagram for explaining a difference in structure among the color developing device 4C3 and a black developing device 4K3 (mentioned later).

In FIG. 9, the structure in the embodiment of the color developing device 4Y3, 4M3, and 4C3 is a structure suitable to be used for the color image forming apparatus A3 in which the intermediate transfer member 6 is arranged vertically, and the size of the structure is made small in a heightwise direction.

Since three color developing devices 4Y3, 4M3, and 4C3 in this embodiment are made with the same structure, the structure of the developing device 4C3 of a cyan color is explained as a representative of them. Although the difference in structure between the color developing device 4C3 and the black developing device 4K3 (after-mentioned) is later mentioned with reference to FIGS. 3 and 5, the storage capacity of developer in the black developing device 4K3 is constituted to become larger than the color developing device 4C3.

The structure of the color developing device 4C3 is similar to the structure of the color developing device 4C1 explained in FIG. 2, since the members which have the same functions are provided with the same reference number, detailed descriptions are omitted, and only parts having different structures are explained.

In this connection, about the plan view of the lower section mechanism in the color developing device 4C3 in this embodiment and the action of circulating developer, since these are similar with those in the color developing device 4C1 explained in FIG. 3, descriptions for these are omitted.

The difference in structure between the color developing device 4C3 and the color developing device 4C1 explained in FIG. 2 is the point that the color developing device 4C1 is structured to make the size in the transverse direction to be smaller, in contrast, the developing device four A3 is structured to make the size in the heightwise direction to be smaller. That is, in the color developing device 4C1, the developing roller 41 is arranged so as to be shifted above the recovering and feeding screw 43. On the other hand, in the developing device four A3, the developing roller 41 is arranged to be placed side by side in the transverse direction of the recovering and feeding screw 43. Therefore, although the width dimension w3 of the developing device casing member 40 of the color developing device 4C3 becomes larger than the width dimension w1 of the developing device casing member 40 of the color developing device 4C1, the height of the whole body of the color developing device 4C3 becomes lower than the color developing device 4C1. By making the height of the color developing device 4C3 (including 4Y3, 4M3) low, it is structured to prevent an increase in the height of the color image forming apparatus A3.

The developing roller 41 is arranged opposite to the photoreceptor 1 such that its rotation center is located at the position having an elevation angle θ3 from the rotation center of the photoreceptor 1C.

Moreover, in the color developing device 4C1, the fixed magnetic pole member 41B is formed with five magnetic poles, on the other hand, in the color developing device 4C3, it is formed with seven magnetic poles of N1, N2, N3, N4, S1, S2, and S3.

That is, in the fixed magnetic pole member 41B in the color developing device 4C3, the seven magnetic poles are formed with a developing pole N1, a recovering and conveying pole S1, a scraping pole N2, a scooping pole N3, a regulating pole S2 and feeding and conveying poles N4 and S3 in this order in the rotating direction of the developing roller 41.

In this embodiment, the fixed magnetic pole member 41B is attached to the developing device casing member 40 such that the developing pole N1 has an angle of about 4 degrees inclined to the upstream side in the rotation direction of the photoreceptor 1 from the straight line which proceeds with the elevation angle θ3 from the rotation center of a photoreceptor 1 to the rotation center of the developing roller 41.

The scraping pole N2 being the first repelling pole and the scooping poles N3 being the second repelling pole are two magnetic poles having the same polarity and being adjacent to each other and form a repelling magnetic pole N0. The recovering and conveying pole S1 is arranged at a middle point between the developing pole N1 and the scraping pole N2.

The line of magnetic force of the repelling pole N0 is formed with an angle to proceed from the fixed magnetic pole member 41*b* to near the rotation center of the recovering and feeding screw 43. The line of magnetic force of the regulating pole S2 is formed with an angle to proceed from the fixed magnetic pole member 41B to the leading end of the regulating member 42. The feeding and conveying poles N4 and S3 are arranged between the regulating pole S2 and the developing pole N1.

The fixed magnetic pole member 41B, 4M3 and 4C3 of each of the three color developing devices 4Y3 used for the third embodiment has the structure that the angle allocation values between each fixed magnetic poles are the same.

Especially, an angle γ1 between the developing pole N1 and the repelling pole N0 and an angle γ2 between the repelling pole N0 and the regulating pole S2 are made to be the same among the three color developing devices 4Y3, 4M3, and 4C3 and are an important include angle having an effect in the conveying performance for developer in the developing device 4C3.

The fixed magnetic pole member 41B is attached to the developing device casing member 40 with an angle in which the center of the line of magnetic force of the developing pole N1 proceeds toward a developing region formed on the photoreceptor 1.

In this embodiment, the fixed magnetic pole member 41B is attached to the developing device casing member 40 such that the developing pole N1 has an angle of about 4 degrees inclined to the upstream side in the rotation direction of the photoreceptor 1 from the straight line which proceeds with the elevation angle θ3 from the rotation center of a photoreceptor 1 to the rotation center of the developing roller 41.

Black Developing Device 4K3 Used for the Third Embodiment

Figure 10:
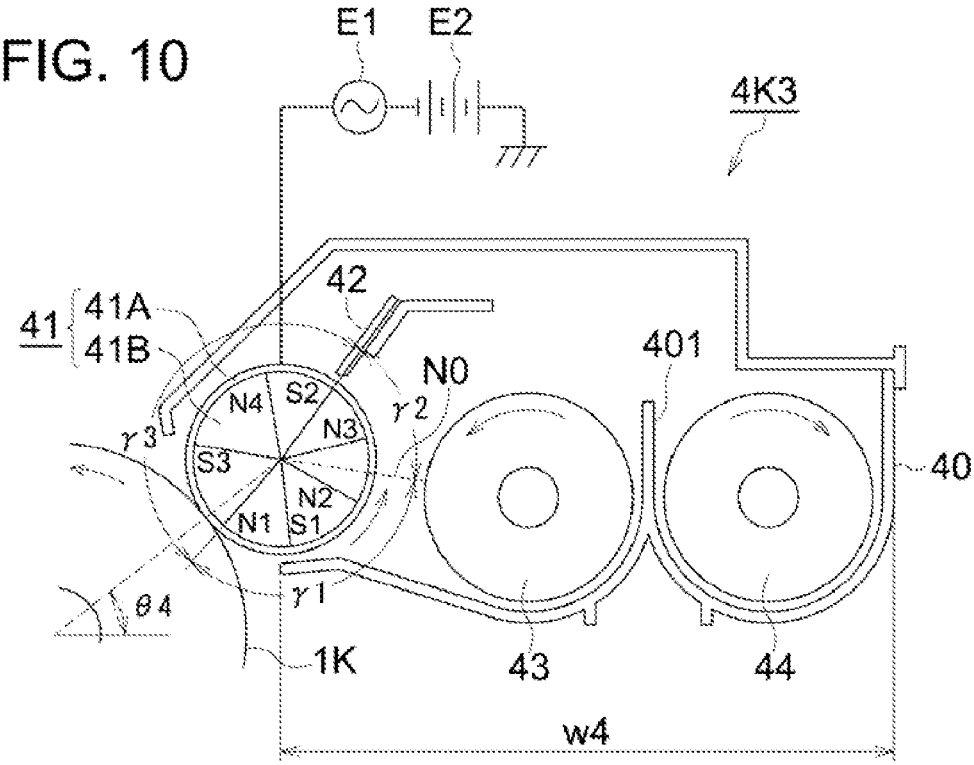
FIG. 10 is a sectional view for explaining the structure about a black developing device used for the color image forming apparatus A3 of the third embodiment of the present invention.

FIG. 10 is a sectional view for explaining the structure about a black developing device 4K3 used for the color image forming apparatus A3 of the third embodiment according to the present invention.

Since the structure of the black developing device 4K3 is similar to the structure of the color developing device 4C3 explained in FIG. 9 and the members which have the same functions are provided with the same reference number, detailed descriptions are omitted, and only parts having different structures are explained. Hereafter, differences in structures between the black developing device 4K3 and the color developing device 4C3 are mainly explained with reference to FIGS. 10 and 11.

The black developing device 4K3 has the structure suitable for being used for the color image forming apparatus A3 as same as the color developing device 4C3, and is constituted such that the size in a heightwise direction becomes small.

About the plan view of the lower section mechanism in the black developing device 4K3 and the action of circulating developer, since these are similar with those in the color developing device 4C1 explained in FIG. 4, descriptions for these are omitted.

Next, with reference to FIG. 11, the positional relationship among the black developing device 4K3 and the color developing device 4C3 in the image forming units 9C and 9K according to this embodiment, and a difference in structure between the black developing device 4K3 and the color developing device 4C3 are explained.

In this embodiment, in order to make a developer storing amount of the black developing device 4K3 larger than that of the color developing device 4C3 (including 4Y3, 4M3), the size of the width direction of the developing device casing member 40, the outside diameter size of the recovering and supplying member 43 and the agitating screw 44 are changed.

That is, the width dimension w4 of the developing device casing member 40 of the black developing device 4K3 is made larger than the width dimension w3 of the color developing device 4C3 (including 4Y3, 4M3). Moreover, in order to prevent the performance decrement in agitating, conveying, feeding and recovering developer in connection with an increment of the width dimension w4 of the black developing device 4K3, the outside diameter size of the agitating screw 44 and the recovering and feeding screw 43 in the black developing device 4K3 is enlarged.

In the black developing device 4K3, by enlarging the outside diameter size of the agitating screw 44 and the recovering and feeding screw 43, the height of the rotation center of the developing roller 41 becomes high.

Here, the developing roller 41 in the black developing device 4K3 is located on a line with the elevation angle θ4 from the rotation center of the photoreceptor 1K to the horizontal line passing through the rotation center of the photoreceptor 1K, and similarly the rotation center of the developing roller 41 in the color developing device 4C3 is located on the line with the elevation angle θ3. At this time, since the height of the developing roller 41 in the black developing device 4K3 is higher than the height of the developing roller 41 in the color developing device 4C3, the elevation angle θ4 becomes a larger value than θ3.

On the other hand, respective angle allocation values of the seven magnetic poles of N1, N2, N3, N4, S1 and S2 in the fixed magnetic pole member 41B of the black developing device 4K3 is set to be the same value as same as the color developing device 4C3.

Since the angle allocation values among the fixed magnetic poles are constituted to be the same value, the mounting angle of the fixed magnetic pole member 41B in the peripheral direction to the developing device casing member 40 is attached at a different angle in correspondence with different elevation angles θ3 and θ4 in the blade developing device 4K3 and the color developing device 4C3.

With the structure that the angle allocation values among the fixed magnetic poles are constituted to be the same value in the black developing device 4K3 and the color developing device 4C3, it becomes possible to make flows of feeding developer to and recovering developer from the developing roller 41 to be the same performance.

According to the present invention, although there are differences in structure between the black developing device 4K3 and the color developing device 4C3, with the structure to makes an angle allocation value between fixed magnetic poles to be the same value, it can cause advantages that the performance of feeding and recovering developer does not change and the common image correction control can be performed.

In the black developing device 4K3 and the color developing device 4C3 according to the embodiment of the present invention, the outside diameter size of the developing sleeve 41A is set up identically. By making the outside diameter size of the developing sleeve 41A to be the same, the fixed magnetic pole member 41B also has the same size. Therefore, the standardization to make the common size becomes possible, and it can be contributed to the cutback of the manufacturing cost of the developing sleeve 41A and the fixed magnetic pole member 41B.

However, it is also possible to change the outside diameter size of the developing sleeve 41A between the black developing device 4K3 and the color developing device 4C3.

About the plan view of the lower section mechanism in the black developing device 4K3 and the action of circulating developer, since these are similar with those in the color developing device 4C1 explained in FIG. 4, descriptions for these are omitted.

Fourth Embodiment

The color image forming apparatus A4 of the fourth embodiment is similar with the color image forming apparatus A3, and a difference is only the structure of a developing device. Therefore, the same figure (FIG. 8) is used. Since the structure and other actions of the color image forming apparatus A4 are the same as that of the color image forming apparatus A3, the descriptions about them are omitted and only the structure and the action of the developing device are explained below.

Color Developing Device 4Y4, 4M4, 4C4 Used for the Fourth Embodiment

Figure 12:
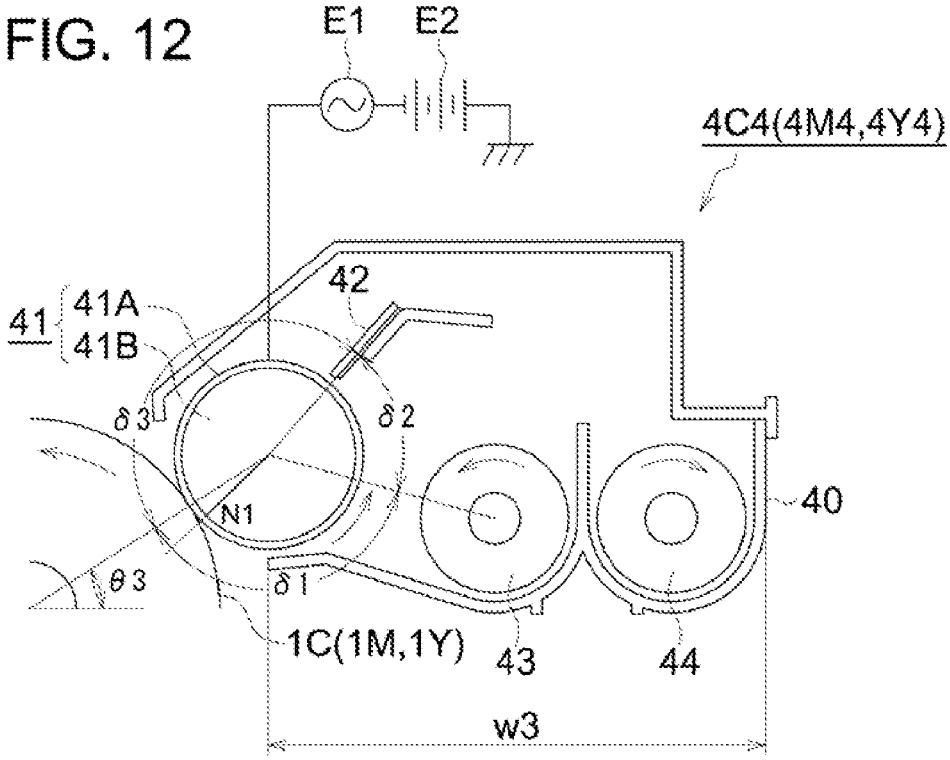
FIG. 12 is a sectional view for explaining the structure about a color developing device used for the color image forming apparatus A4 of the fourth embodiment of the present invention.

FIG. 12 is a sectional view for explaining the structure about the embodiment of the color developing devices 4Y4, 4M4, 4C4 used for the color image forming apparatus A4 of the fourth embodiment according to the present invention.

The color developing devices 4Y4, 4M4, 4C4 have a structure suitable for being used for the color image forming apparatus A4, and the size of the structure is made small in its heightwise direction.

Since three color developing devices 4Y4, 4M4, and 4C4 according to this embodiment have the same structure, the structure of the color developing device 4C2 shown in FIG. 12 is explained as the representative.

The structure of the color developing device 4C4 is similar to the structure of the color developing device 4C3 explained in FIG. 7, since the members which have the same functions are provided with the same reference number, detailed descriptions are omitted, and only parts having different structures are explained. The explanation about differences in structure between the color developing device 4C4 and the black developing device 4K4 is mentioned later with reference to FIGS. 11 to 13.

The color developing device 4C4 has a structure suitable for being used for the color image forming apparatus A4, and the size of the structure is made small in its longitudinal direction.

A constitutional different point between the color developing device 4C3 and the color developing device 4C4 is a difference between the point that the angle allocation values of the fixed magnetic poles are constituted with the same value and the point that the angle allocation values in arrangement of the constructing members are constituted with the same value. That is, the color developing devices 4C3 is constituted such that the angle allocation values in the fixed magnetic poles of the developing roller 41 are made with the same values, in contrast, the color developing devices 4C4 is constituted such that the angle allocation value in the arrangements of the constructing members are made with the same values as same as the color developing devices 4C4 explained with reference to FIG. 6.

In the three color developing devices 4C4 shown in FIG. 12, the position of the rotation centre of the photoreceptor 1C, the position of the rotation centre of the recovering and feeding screw 43, and the position of the leading end of the regulating member 42 are arranged around the developing roller 41 with the same angle allocation values on the basis of the rotation center of the developing roller 41. Namely, in FIG. 12, if angles formed by these three straight lines are represented respectively with δ1, δ2, and δ3, in all of the three color developing devices 4C4, 4M4, and 4Y4, the angle allocation values in the arrangements of the three constructing members are represented with the same values of δ1, δ2, and δ3. Especially, an angle δ1 between the line passing the position of the rotation centre of the photoreceptor 1C and the line passing the position of the rotation centre of the recovering and feeding screw 43 and an angle δ2 between the line passing the position of the rotation centre of the recovering and feeding screw 43 and the line passing the position of the leading end of the regulating member 42 are important angles in securing the conveying performance for developer.

In all of the color developing devices 4C4, 4M4, and 4Y4, flows of feeding and recovering developer can be made with the same performance by making the angle allocation values of the photoreceptor 1, the recovering and feeding screw 43 and the regulating member 42 around the developing roller 41 to be the same values.

Besides, since explanations about the plan view of the lower section mechanism of the color developing device 4C4 and the action of circulating developer are the same as those in the color developing device 4C1 of the first embodiment shown in FIG. 4, the explanations are omitted.

Black Developing Device 4K4 Used for the Fourth Embodiment

Next, the structure of the black developing device 4K4 used for the color image forming apparatus A4 is explained.

The structure of the black developing device 4K4 according to this embodiment is similar to the structure of the black developing device 4C3 used in the color image forming apparatus A3 of the third embodiment, since the members which have the same functions are provided with the same reference number, detailed descriptions are omitted, and only parts having different structures are explained.

Figure 13:
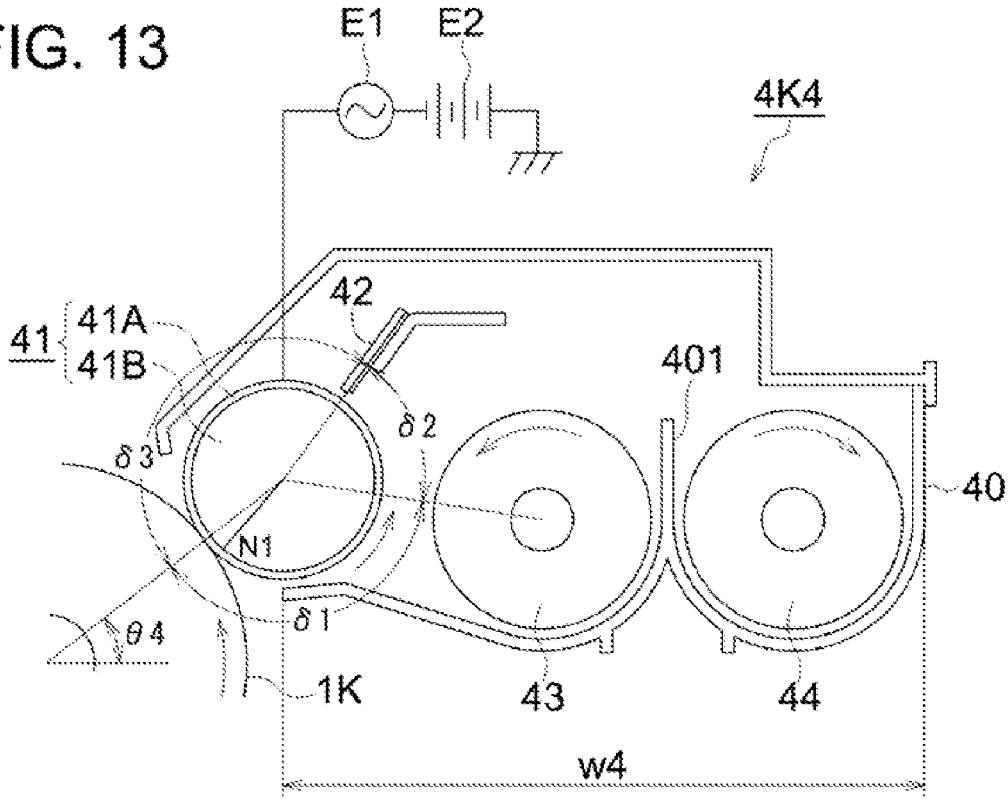
FIG. 13 is a sectional view for explaining the structure about a black developing device used for the color image forming apparatus A4 of the fourth embodiment of the present invention.
Figure 14:
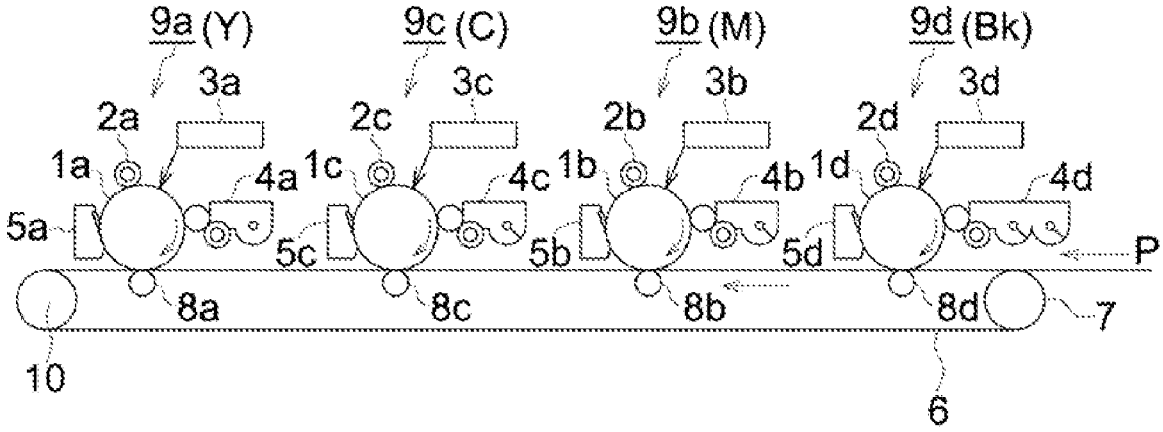
FIG. 14 is a schematic diagram showing the first embodiment of a conventional color image forming apparatus.
Figure 15:
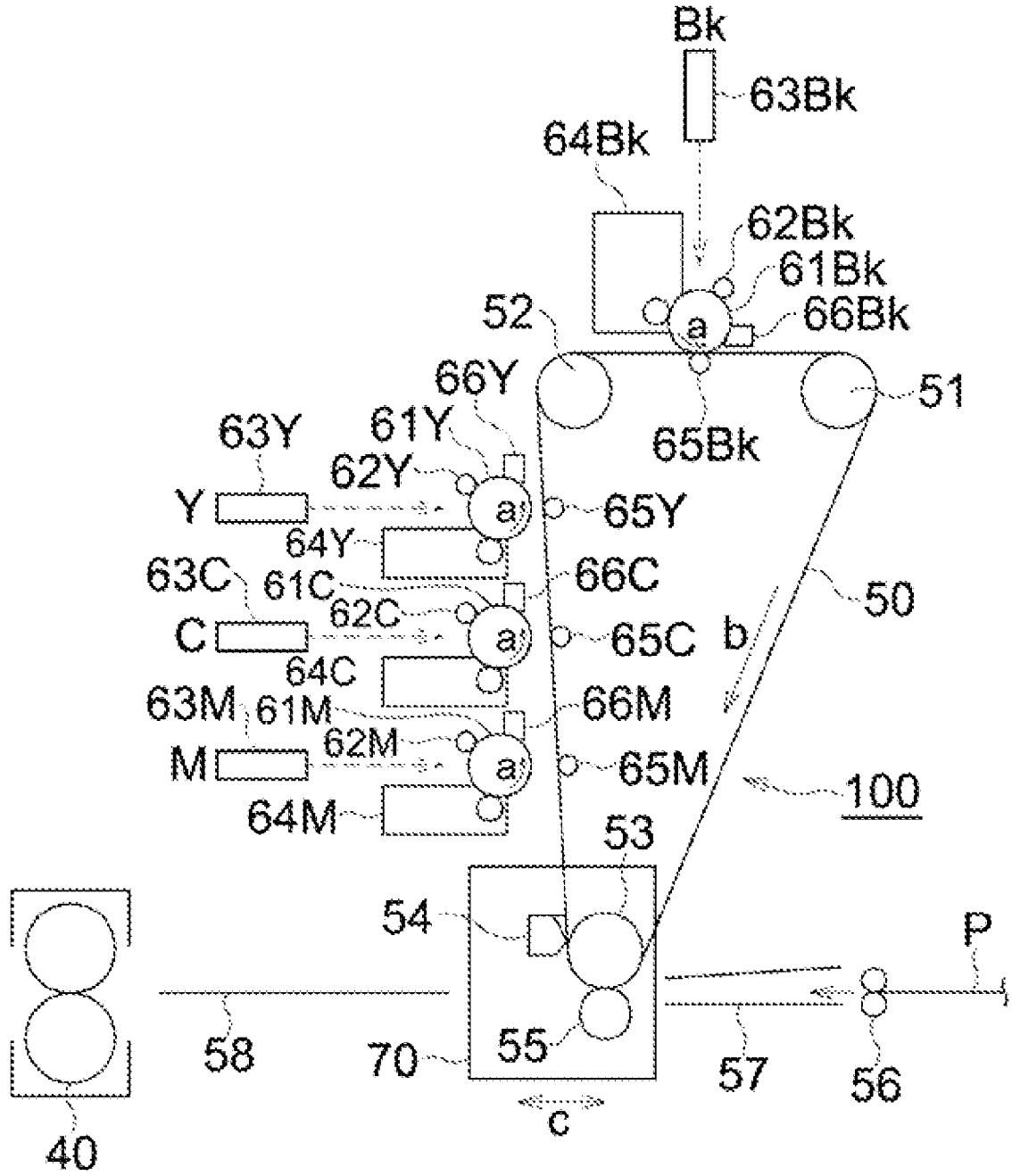
FIG. 15 is a schematic diagram showing another embodiment of a conventional color image forming apparatus.

FIG. 13 is a sectional view for explaining the structure of the black developing device 4K4.

In FIG. 13, in order to make the developer storage capacity of the black developing device 4K4 larger than that of the color developing device 4C4, the black developing device 4K4 is constituted such that the size of the developing device casing member 40 becomes larger as same as that of the black developing device 4K3. That is, the width dimension w4 of the developing device casing member 40, and the elevation angle θ4 from the centre position of the photoreceptor 1K to the centre position of the developing roller 41 are the same values in the black developing device 4K3.

The point that the black developing device 4K4 differs from the black developing device 4K3 is the same as the different point between the color developing device 4C3 and the color developing device 4C4.

That is, the different point is that the black developing device 4K3 is constituted so as to make the angle allocation values of the fixed magnetic poles to be the same values, in contrast, the black developing device 4K4 is constituted so as to make the angle allocation values in the arrangement of the constructing members to be the same values.

As same the color developing device 4C4, the black developing device 4K4 has the structure that three members of the photoreceptor 1C, the recovering and feeding screw 43 and the regulating member 42 are arranged around the developing roller 41 with the same angle allocation values on the basis of the rotation center of the developing roller 41. That is, if the arrangement of the three above-mentioned members is expressed with three straight lines as shown in FIG. 13, the angle allocation values between three straight lines become δ1, δ2, and δ3. These angle allocation values are the same as those of the angle allocation values of the color developing device 4C4 explained in FIG. 12, whereby all of the four developing devices 4Y4, 4M4, 4C4, and 4K4 have the same values.

By constituting such that the angle allocation values of the photoreceptor 1, the recovering and feeding screw 43 and the regulating member 42 around the developing roller 41 are the same values in all the developing devices, it becomes possible to make flows of feeding and recovering developer to the developing roller 41 to be equivalent.

According to the present invention, even if there are differences in structure between the color developing device 4C4 and the black developing device 4K4, since the flows of feeding and recovering developer do not change with the structure that the angle allocation values between members are made the same values, there may arise the advantage that the common image correction control can be performed.

About the difference in structure between the black developing device 4K2 and the color developing device 4C2, since it is the same with the difference in structure between the black developing device 4K1 and the color developing device 4C1, an explanation about the difference is omitted.

[Developer]

The developer used in this embodiment is a two component type developer which includes magnetic carrier and nonmagnetic polymer toner. The particle size of the magnetic carrier is 50 μm or less. The particle size of the nonmagnetic polymer toner is 7.5 μm or less.

EXAMPLE

Using the color image forming apparatus incorporating the developing device described in Example and Comparative example which are shown below, the inventor conducted experiments for image evaluation by printing color and black images.

Example 1

1. Image Forming Apparatus:

Color image forming apparatus A1 (tandem type color image forming apparatus, the color image forming apparatus of the first embodiment shown in FIG. 1)

2. Developing Device:

Black developing device 4K1 (longitudinally long type, refer to FIG. 3), Color developing devices 4Y1, 4M1, and 4C1 (longitudinally long type, refer to FIG. 2)

(1) Black developing device 4K1

Developer storage capacity: 1200 g

Outside-diameter of developing roller 41; 25 mm

Outside-diameter of the recovering and feeding screw 43: 24 mm

Magnetic-flux-density of developing pole N1: 120 mT (Millistera)

Magnetic-flux-density of regulating pole N2: 60 mT

Magnetic-flux-density of scraping pole S1 and scooping pole S2: −80 mT

Magnetic-flux-density of conveying pole S3: −60 mT

Angle α1 formed by developing pole N1 and repelling pole S0: 93°

Angle α2 formed by repelling pole S0 and regulating pole N2: 140°

Angle formed by scraping pole S1 and scooping pole S2: 90°

Angle formed by regulating pole N2 and conveying pole S3: 65°

Deviation between a line connecting the center of developing roller 41 with the center of photoreceptor and developing pole N1: 4°

Elevation angle θ2 of the center of developing roller 41 from the center of photoreceptor 1: 20°

Gap d1 between developing roller 41 and recovering and feeding roller 43: 2 mm Developer: two component type developer composed of magnetic carrier and nonmagnetic polymer toner (particle size of magnetic carrier: 50 μm or less, particle size of nonmagnetic polymer toner: 7.5 μm or less)

(2) Color developing device 4Y1, 4M1, 4C1

Developer storage capacity: 800 g

Outside-diameter of the recovering and feeding screw 43: 20 mm

Elevation angle θ1 of the center of developing Roller 41 from the center of photoreceptor 1: 15°

Other specifications: the same with those of the black developing device 4K1 described in (1)

Example 2

1. Image Forming Apparatus:

Color image forming apparatus A2 (tandem type color image forming apparatus, the color image forming apparatus of the second embodiment shown in FIG. 1)

2. Developing Device:

Black developing device 4K2 (longitudinally long type, refer to FIG. 7), Color developing devices 4Y2, 4M2, and 4C2 (longitudinally long type, refer to FIG. 6)

(1) Black developing device 4K2

Developer storage capacity: 1200 g

Outside-diameter of developing roller 41: 25 mm

Outside-diameter of the recovering and feeding screw 43: 24 mm

Magnetic-flux-density of developing pole N1; 120 mT (Millistera)

Magnetic-flux-density of regulating pole N2: 60 mT

Magnetic-flux-density of scraping pole S1 and scooping pole S2: −80 mT

Magnetic-flux-density of conveying pole S3: −60 mT

Angle β1 formed by a line connecting the center of developing roller 41 and the center of photoreceptor and a line connecting the center of developing roller and the center of recovering and feeding screw 43: 89°

Angle β2 formed by a line connecting the center of developing roller 41 with the center of recovering and feeding screw 43 and a line connecting the center of developing roller 41 with the leading end of regulating member 42: 140°

Deviation between a line connecting the center of developing roller 41 with the center of photoreceptor and regulating pole N2: 4°

Elevation angle of the center of developing roller 41 from the center of photoreceptor 1: 20°

Gap d1 between developing roller 41 and recovering and feeding roller 43: 2 mm Developer: two component type developer composed of magnetic carrier and nonmagnetic polymer toner (particle size of magnetic carrier: 50 μm or less, particle size of nonmagnetic polymer toner: 7.5 μm or less)

(2) Color developing device 4Y2, 4M2, 4C2

Developer storage capacity: 800 g

Outside-diameter of the recovering and feeding screw 43: 20 mm

Elevation angle θ1 of the center of developing roller 41 from the center of photoreceptor 1: 15°

Other specifications: the same with those of the black developing device 4K4 described in (1)

Example 3

1. Image Forming Apparatus:

Color image forming apparatus A3 (tandem type color image forming apparatus, the color image forming apparatus of the third embodiment shown in FIG. 8)

2. Developing Device:

Black developing device 4K3 (transversely long type, refer to FIG. 10),

Color developing devices 4Y3, 4M3, and 4C3 (transversely long type, refer to FIG. 9)

(1) Black developing device 4K3

Developer storage capacity: 1200 g

Outside-diameter of developing roller 41: 30 mm

Outside-diameter of the recovering and feeding screw 43: 32 mm

Magnetic-flux-density of developing pole N1: 120 mT (Millistera)

Magnetic-flux-density of scraping pole N2 and scooping pole N3: 80 mT

Magnetic-flux-density of feeding and conveying pole N4: 60 mT

Magnetic-flux-density of recovering and conveying pole S1: −60 mT

Magnetic-flux-density of regulating pole S2: −60 mT

Magnetic-flux-density of feeding and conveying pole S3: −60 mT

Angle γ1 formed by developing pole N1 and repelling pole N0: 130°

Angle γ2 formed by repelling pole N0 and regulating pole S2: 62°

Angle formed by scraping pole N2 and scooping pole N3: 60°

Angle formed by regulating pole S2 and feeding and conveying pole N4: 50°

Angle formed by regulating pole S2 and feeding and conveying pole S3: 110°

Deviation between a line connecting the center of developing roller 41 with the center of photoreceptor and regulating pole N2: 4°

Elevation angle θ4 of the center of developing Roller 41 from the center of photoreceptor 1: 38°

Gap d1 between developing roller 41 and recovering and feeding roller 43: 3 mm Developer: two component type developer composed of magnetic carrier and nonmagnetic polymer toner (particle size of magnetic carrier: 50 μm or less, particle size of nonmagnetic polymer toner: 7.5 μm or less)

(2) Color developing device 4Y3, 4M3, 4C3

Developer storage capacity: 800 g

Outside-diameter of the recovering and feeding screw 43: 27 mm

Elevation angle θ3 of the center of developing roller 41 from the center of photoreceptor 1: 28°

Gap d4 between developing roller 41 and recovering and feeding roller 43: 5 mm Other specifications: the same with those of the black developing device 4K1 described in (1)

Example 4

1. Image Forming Apparatus:

Color image forming apparatus A4 (tandem type color image forming apparatus, the color image forming apparatus of the fourth embodiment shown in FIG. 8)

2. Developing Device:

Black developing device 4K4 (transversely long type, refer to FIG. 13),

Color developing devices 4Y4, 4M4, and 4C4 (transversely long type, refer to FIG. 12)

(1) Black developing device 4K4

Developer storage capacity: 1200 g

Outside-diameter of developing roller 41: 30 mm

Outside-diameter of the recovering and feeding screw 43: 32 mm

Magnetic-flux-density of developing pole N1: 120 mT (Millistera)

Magnetic-flux-density of scraping pole N2 and scooping pole N3: 80 mT

Magnetic-flux-density of feeding and conveying pole N4: 60 mT

Magnetic-flux-density of recovering and conveying pole S1: −60 mT

Magnetic-flux-density of regulating pole S2: −60 mT

Magnetic-flux-density of feeding and conveying pole S3: −60 mT

Angle δ1 formed by a line connecting the center of developing roller 41 with the center of photoreceptor 1 and a line connecting the center of developing roller 41 with the center of recovering and feeding screw 43: 134°

Angle δ2 formed by a line connecting the center of developing roller 41 with the center of recovering and feeding screw 43 and a line connecting the center of developing roller 41 with the leading end of regulating member 42: 62°

Angle formed by scraping pole N2 and scooping pole N3: 60°

Angle formed by regulating pole S2 and feeding and conveying pole N4: 50°

Angle formed by regulating pole S2 and feeding and conveying pole S3: 110°

Deviation between a line connecting the center of developing roller 41 with the center of photoreceptor 1 and regulating pole N2: 4°

Elevation angle θ4 of the center of developing roller 41 from the center of photoreceptor 1: 38°

Gap d3 between developing roller 41 and recovering and feeding roller 43: 3 mm Developer: two component type developer composed of magnetic carrier and nonmagnetic polymer toner (particle size of magnetic carrier: 50 μm or less, particle size of nonmagnetic polymer toner: 7.5 μm or less)

(2) Color developing device 4Y4, 4M4, 4C4

Developer storage capacity: 800 g

Outside-diameter of the recovering and feeding screw 43: 27 mm

Elevation angle θ3 of the center of developing roller 41 from the center of photoreceptor 1: 28°

Gap d4 between developing roller 41 and recovering and feeding roller 43: 5 mm Other specifications: the same with those of the black developing device 4K4 described in (1)

Comparative Example 1

1. Image Forming Apparatus:

A modified machine of color image forming apparatus A1 (tandem type color image forming apparatus in which the developing device of the color image forming apparatus of the first embodiment shown in FIG. 1 was modified with the below specifications)

2. Developing Device:

Black developing device 4K5 (longitudinally long type, since this developing device was similar to the black developing device 4K1 shown in FIG. 3, the drawing and the explanation about the structure are omitted. The specifications of this developing device was the same with the black developing device 4K1 except the below-mentioned specifications), Color developing devices 4Y5, 4M5, and 4C5 (longitudinally long type, since these developing devices were similar to the color developing devices 4Y1, 4M1, 4C1 shown in FIG. 2, the drawing and the explanation about the structure are omitted. The specifications of these developing devices was the same with the color developing devices 4Y1, 4M1, 4C1 except the below-mentioned specifications)

(1) Black developing device 4K5

Angle α1 formed by developing pole N1 and repelling pole S0: 88°

Other specifications: the same with those of the black developing device 4K1

(2) Color developing devices 4Y5, 4M5, 4C5

Angle α1 formed by developing pole N1 and repelling pole S0: 93°

Other specifications: the same with those of the color developing devices 4Y1, 4K1, 4C1

Comparative Example 2

1. Image Forming Apparatus:

A modified machine of color image forming apparatus A1 (tandem type color image forming apparatus in which the developing device of the color image forming apparatus of the first embodiment shown in FIG. 1 was modified with the below specifications)

2. Developing Device:

Black developing device 4K6 (longitudinally long type, since this developing device was similar to the black developing device 4K1 shown in FIG. 3, the drawing and the explanation about the structure are omitted. The specifications of this developing device was the same with the black developing device 4K1 except the below-mentioned specifications), Color developing devices 4Y6, 4M6, and 4C6 (longitudinally long type, since these developing devices were similar to the color developing devices 4Y1, 4M1, 4C1 shown in FIG. 2, the drawing and the explanation about the structure are omitted. The specifications of these developing devices was the same with the color developing devices 4Y1, 4M1, 4C1 except the below-mentioned specifications)

(1) Black developing device 4K6

Angle α2 formed by repelling pole S0 and regulating pole N2: 135°

Other specifications: the same with those of the black developing device 4K1

(2) Color developing devices 4Y6, 4M6, 4C6

Angle α2 formed by repelling pole S0 and regulating pole N2: 140°

Other specifications: the same with those of the color developing devices 4Y1, 4M1, 4C1

Comparative Example 3

1. Image Forming Apparatus:

A modified machine of color image forming apparatus A2 (tandem type color image forming apparatus in which the developing device of the color image forming apparatus of the second embodiment shown in FIG. 1 was modified with the below specifications)

2. Developing Device:

Black developing device 4K7 (longitudinally long type, since this developing device was similar to the black developing device 4K2 shown in FIG. 7, the drawing and the explanation about the structure are omitted. The specifications of this developing device was the same with the black developing device 4K1 except the below-mentioned specifications), Color developing devices 4Y7, 4M7, and 4C7 (longitudinally long type, since these developing devices were similar to the color developing devices 4Y2, 4M2, 4C2 shown in FIG. 6, the drawing and the explanation about the structure are omitted. The specifications of these developing devices was the same with the color developing devices 4Y1, 4M1, 4C1 except the below-mentioned specifications)

(1) Black developing device 4K7

Angle β1 formed by a line connecting the center of developing roller 41 and the center of photoreceptor and a line connecting the center of developing roller and the center of recovering and feeding screw 43: 84°

Other specifications: the same with those of the black developing device 4K2

(2) Color developing devices 4Y7, 4M7, 4C7

Angle β1 formed by a line connecting the center of developing roller 41 and the center of photoreceptor and a line connecting the center of developing roller and the center of recovering and feeding screw 43: 89°

Other specifications: the same with those of the color developing devices 4Y2, 4M2, 4C2

Comparative Example 4

1. Image Forming Apparatus:

A modified machine of color image forming apparatus A2 (tandem type color image forming apparatus in which the developing device of the color image forming apparatus of the second embodiment shown in FIG. 1 was modified with the below specifications)

2. Developing Device:

Black developing device 4K8 (longitudinally long type, since this developing device was similar to the black developing device 4K2 shown in FIG. 7, the drawing and the explanation about the structure are omitted. The specifications of this developing device was the same with the black developing device 4K1 except the below-mentioned specifications), Color developing devices 4Y8, 4M8, and 4C8 (longitudinally long type, since these developing devices were similar to the color developing devices 4Y2, 4M2, 4C2 shown in FIG. 6, the drawing and the explanation about the structure are omitted. The specifications of these developing devices was the same with the color developing devices 4Y2, 4M2, 4C2 except the below-mentioned specifications)

(1) Black developing device 4K8

Angle β2 formed by a line connecting the center of developing roller 41 with the center of recovering and feeding screw 43 and a line connecting the center of developing roller 41 with the leading end of regulating member 42: 135°

Other specifications: the same with those of the black developing device 4K2

(2) Color developing devices 4Y8, 4M8, 4C8

Angle β2 formed by a line connecting the center of developing roller 41 with the center of recovering and feeding screw 43 and a line connecting the center of developing roller 41 with the leading end of regulating member 42: 140°

Other specifications: the same with those of the color developing devices 4Y2, 4M2, 4C2

Comparative Example 5

1. Image Forming Apparatus:

A modified machine of color image forming apparatus A3 (tandem type color image forming apparatus in which the developing device of the color image forming apparatus of the third embodiment shown in FIG. 8 was modified with the below specifications)

2. Developing Device:

Black developing device 4K9 (transversely long type, since this developing device was similar to the black developing device 4K3 shown in FIG. 10, the drawing and the explanation about the structure are omitted. The specifications of this developing device was the same with the black developing device 4K1 except the below-mentioned specifications), Color developing devices 4Y9, 4M9, and 4C9 (transversely long type, since these developing devices were similar to the color developing devices 4Y3, 4M3, 4C3 shown in FIG. 9, the drawing and the explanation about the structure are omitted. The specifications of these developing devices was the same with the color developing devices 4Y3, 4M3, 4C3 except the below-mentioned specifications)

(1) Black developing device 4K9

Angle γ1 formed by developing pole N1 and repelling pole S0: 120°

Other specifications: the same with those of the black developing device 4K3

(2) Color developing devices 4Y9, 4M9, 4C9

Angle γ1 formed by developing pole N1 and repelling pole S0: 130°

Other specifications: the same with those of the color developing devices 4Y3, 4M3, 4C3

Comparative Example 6

1. Image Forming Apparatus:

A modified machine of color image forming apparatus A3 (tandem type color image forming apparatus in which the developing device of the color image forming apparatus of the third embodiment shown in FIG. 8 was modified with the below specifications)

2. Developing Device:

Black developing device 4K10 (transversely long type, since this developing device was similar to the black developing device 4K3 shown in FIG. 10, the drawing and the explanation about the structure are omitted. The specifications of this developing device was the same with the black developing device 4K1 except the below-mentioned specifications), Color developing devices 4Y10, 4M10, and 4C10 (transversely long type, since these developing devices were similar to the color developing devices 4Y3, 4M3, 4C3 shown in FIG. 9, the drawing and the explanation about the structure are omitted. The specifications of these developing devices was the same with the color developing devices 4Y3, 4M3, 4C3 except the below-mentioned specifications)

(1) Black developing device 4K10

Angle γ2 formed by repelling pole N0 and regulating pole S2: 52°

Other specifications: the same with those of the black developing device 4K3

(2) Color developing devices 4Y10, 4M10, 4C10

Angle γ2 formed by repelling pole N0 and regulating pole S2: 62°

Other specifications: the same with those of the color developing devices 4Y3, 4M3, 4C3

Comparative Example 7

1. Image Forming Apparatus:

A modified machine of color image forming apparatus A4 (tandem type color image forming apparatus in which the developing device of the color image forming apparatus of the fourth embodiment shown in FIG. 8 was modified with the below specifications)

2. Developing Device:

Black developing device 4K11 (transversely long type, since this developing device was similar to the black developing device 4K4 shown in FIG. 13, the drawing and the explanation about the structure are omitted. The specifications of this developing device was the same with the black developing device 4K1 except the below-mentioned specifications), Color developing devices 4Y11, 4M11, and 4C11 (transversely long type, since these developing devices were similar to the color developing devices 4Y4, 4M4, 4C4 shown in FIG. 12, the drawing and the explanation about the structure are omitted. The specifications of these developing devices was the same with the color developing devices 4Y4, 4M4, 4C4 except the below-mentioned specifications)

(1) Black developing device 4K11

Angle δ1 formed by a line connecting the center of developing roller 41 with the center of photoreceptor 1 and a line connecting the center of developing roller 41 with the center of recovering and feeding screw 43: 124°

Other specifications: the same with those of the black developing device 4K4

(2) Color developing devices 4Y11, 4M11, 4C11

Angle δ1 formed by a line connecting the center of developing roller 41 with the center of photoreceptor 1 and a line connecting the center of developing roller 41 with the center of recovering and feeding screw 43: 134°

Other specifications: the same with those of the color developing devices 4Y4, 4M4, 4C4

Comparative Example 8

1. Image Forming Apparatus:

A modified machine of color image forming apparatus A4 (tandem type color image forming apparatus in which the developing device of the color image forming apparatus of the fourth embodiment shown in FIG. 8 was modified with the below specifications)

2. Developing Device:

Black developing device 4K12 (transversely long type, since this developing device was similar to the black developing device 4K4 shown in FIG. 13, the drawing and the explanation about the structure are omitted. The specifications of this developing device was the same with the black developing device 4K1 except the below-mentioned specifications), Color developing devices 4Y12, 4M12, and 4C12 (transversely long type, since these developing devices were similar to the color developing devices 4Y4, 4M4, 4C4 shown in FIG. 12, the drawing and the explanation about the structure are omitted. The specifications of these developing devices was the same with the color developing devices 4Y4, 4M4, 4C4 except the below-mentioned specifications)

(1) Black developing device 4K12

Angle δ2 formed by a line connecting the center of developing roller 41 with the center of recovering and feeding screw 43 and a line connecting the center of developing roller 41 with the leading end of regulating member 42: 52°

Other specifications: the same with those of the black developing device 4K4

(2) Color developing devices 4Y12, 4M12, 4C12

Angle δ2 formed by a line connecting the center of developing roller 41 with the center of recovering and feeding screw 43 and a line connecting the center of developing roller 41 with the leading end of regulating member 42: 62°

Other specifications: the same with those of the color developing devices 4Y4, 4M4, 4C4

The results of the experiments are showing in Table 1.

TABLE 1

| | Developing device | | | * 3 | | Comparison in specification between color developing device and black developing device | Evaluation | |
|---|---|---|---|---|---|---|---|---|
| | Type | Black | Color | Color | Black | | Fluctuation in hue | Fluctuation in image density |
| Example 1 | * 1 | 4K1 | 4Y1, ** | 15° | 20° | Magnetic pole angles α1 and α2 are the same | Good | Good |
| Example 2 | * 1 | 4K2 | 4Y2, ** | 15° | 20° | Magnetic pole angles β1 and β2 are the same | Good | Good |

TABLE 1-continued

| | Developing device | | | * 3 | | Comparison in specification between color developing device and black developing device | Evaluation | |
|---|---|---|---|---|---|---|---|---|
| | Type | Black | Color | Color | Black | | Fluctuation in hue | Fluctuation in image density |
| Example 3 | * 2 | 4K3 | 4Y3, ** | 28° | 38° | Magnetic pole angles γ1 and γ2 are the same | Good | Good |
| Example 4 | * 2 | 4K4 | 4Y4, ** | 28° | 38° | Magnetic pole angles δ1 and δ2 are the same | Good | Good |
| Comp. 1 | * 1 | 4K5 | 4Y5, ** | 15° | 20° | Magnetic pole angle α1 is different | * 4 | * 4 |
| Comp. 2 | * 1 | 4K6 | 4Y6, ** | 15° | 20° | Magnetic pole angle α2 is different | * 4 | * 4 |
| Comp. 3 | * 1 | 4K7 | 4Y7, ** | 15° | 20° | Magnetic pole angle β1 is different | * 4 | * 4 |
| Comp. 4 | * 1 | 4K8 | 4Y8, ** | 15° | 20° | Magnetic pole angle β2 is different | * 4 | * 4 |
| Comp. 5 | * 2 | 4K9 | 4Y9, ** | 28° | 38° | Magnetic pole angle γ1 is different | * 4 | * 4 |
| Comp. 6 | * 2 | 4K10 | 4Y10, ** | 28° | 38° | Magnetic pole angle γ2 is different | * 4 | * 4 |
| Comp. 7 | * 2 | 4K11 | 4Y11, ** | 28° | 38° | Magnetic pole angle δ1 is different | * 4 | * 4 |
| Comp. 8 | * 2 | 4K12 | 4Y12, ** | 28° | 38° | Magnetic pole angle δ2 is different | * 4 | * 4 |

* 1: Longitudinally long,
* 2: Transversely long,
* 3: Developing roller position (elevation angle),
* 4: Difficult to correct image,
Comp.: Comparative example,
**: others In the results of the experiments shown in Table 1, in Examples 1 to 4, there were obtained images being stable and having no fluctuation in any one of hue and image density.

In Comparative examples 1 to 8, in any one of the structures, if image correction suitable to color images was conducted, the image density of black images fluctuated. On the other hand, if image correction suitable to black images was conducted, the image density of color images fluctuated. It may be presumed that this phenomenon is caused by the factor that feeding, recovering and conveying states for developer becomes different due to difference in angle allocation values of magnetic poles or constructing members between black and color developing devices.

Besides, the inventor found out through these experiments that stable images can be obtained by setting the location of the developing pole N1 with an inclination of about 4° toward the upstream side of the rotating direction of the photoreceptor 1 from a line connecting the center of the developing roller 41 with the center of the photoreceptor 1 when the fixed magnetic pole members 41B is mounted in the developing device casing member 40.

According to above embodiments, a plurality of developing devices are structured with few members of a developing roller, a regulating member, a recovering and feeding member, a agitating member and a developing device casing member, whereby the miniaturization of the developing device can be attained. Further, by making a black developer storing capacity of a developing device larger than a color developer storing capacity of a developing device, the developing ability of a black image formation having high frequency in use can be enhanced.

Moreover, in the structures of black developing device and color developing devices, by making angle allocation values of fixed magnetic poles in a developing roller or positional relationships on main members to be the same, flows of feeding developer and recovering developer are not changed in these developing devices. With this, the structure of member associating conveyance of developer can be made the same in the plurality of developing devices, whereby the manufacturing cost of these members can be reduced and the toner concentration control can be conducted with the same condition among color units and a black unit.

What is claimed is:

1. A color image forming apparatus, comprising:

a plurality of developing devices;

each of the plurality of developing devices having:

a developing roller including a cylindrical developing sleeve arranged at a position opposite to an image bearing member, supported to be rotatable, to carry developer including toner and carrier, to convey the developer to the image bearing member, and a fixed magnetic pole member arranged inside the developing sleeve and including a plurality of fixed magnetic poles formed in a peripheral direction;

an agitating member to agitate developer;

a recovering and feeding member supported to be rotatable, to feed developer to the developing roller and to recover developer from the developing roller;

a regulating member to regulate an amount of developer fed to the developing roller; and a developing device casing member to store developer therein and to accommodate the developing roller, the regulating member, the agitating member and the recovering and feeding member therein;

wherein at least one of the plurality of developing devices has a different developer storing capacity and a different outer diameter of the recovering and feeding member than the other developing devices and has the same angle allocation values among the plurality of fixed magnetic poles in the fixed magnetic pole member, and all of the developing sleeves of the plurality of developing devices have the same outer diameter.

2. The color image forming apparatus described in claim 1, wherein the developing device having the different toner storing capacity has a larger toner storing capacity and a larger outer diameter of the recovering and feeding member in comparison with the other developing devices.

3. The color image forming apparatus described in claim 1, wherein in the developing device having the different toner storing capacity, a mounting angle of the fixed magnetic pole member in a peripheral direction on the developing device casing member is different in comparison with the other developing devices.

4. The color image forming apparatus described in claim 1, wherein the developing device having the different toner storing capacity is a developing device storing black developer and the other developing devices are developing devices storing color developer and the developer storing capacity of the developing device storing black developer is larger than that of the developing devices storing color developer.

5. The color image forming apparatus described in claim 1, wherein the plurality of fixed magnetic poles in the fixed magnetic pole member includes a developing pole in which the center of lines of magnetic force proceeds near to the rotation center of the image bearing member from the fixed magnetic pole member, a repelling pole in which the center of lines of magnetic force proceeds near to the rotation center of the recovering and feeding member, and a regulating pole in which the center of lines of magnetic force proceeds near to the tip end of the regulating member, and wherein the angle allocation values are angle allocation among the developing pole, the repelling pole and the regulating pole.

6. The color image forming apparatus described in claim 5, wherein the repelling pole includes a first repelling pole arranged toward the upstream side in the rotating direction of the developing roller from a line proceeding from the rotation center of the developing roller to near the rotation center of the recovering and feeding member and a second repelling pole arranged toward the downstream side in the rotating direction of the developing roller from the line, and wherein the fixed magnetic poles are arranged in the peripheral direction in the order of the developing pole, the first repelling pole, the second repelling pole and the regulating pole from the upstream side in the rotating direction of the developing roller.

7. The color image forming apparatus described in claim 1, wherein the developing device having the different toner storing capacity is arranged such that an angle formed by a straight line connecting the rotation center of the developing roller with the rotation center of the image bearing member and a horizontal line passing the rotation center of the image bearing member is different from the other developing devices.

8. The color image forming apparatus described in claim 1, further comprising:

a plurality of image bearing members so as to oppose one to one for the plurality of developing devices.

9. A plurality of process cartridges mounted on or dismounted freely respectively from the color image forming apparatus described in claim 1, comprising:

at least the developing device, and the image bearing member opposite to the developing device.

10. A color image forming apparatus, comprising:

a plurality of developing devices;

each of the plurality of developing devices having:

a developing roller including a cylindrical developing sleeve arranged at a position opposite to an image bearing member, supported to be rotatable, to carry developer including toner and carrier, to convey the developer to the image bearing member, and a fixed magnetic pole member arranged inside the developing sleeve and including a plurality of fixed magnetic poles formed in a peripheral direction;

an agitating member to agitate developer;

a recovering and feeding member supported to be rotatable, to feed developer to the developing roller and to recover developer scraped from the developing roller;

a regulating member to regulate an amount of developer fed to the developing roller; and a developing device casing member to store developer therein and to accommodate the developing roller, the regulating member, the regulating member and the recovering and feeding member therein;

wherein at least one of the plurality of developing devices has a different developer storing capacity and a different outer diameter of the recovering and feeding member than the other developing devices and has the same angle allocation values between the following three straight lines:

a straight line connecting the rotation center of the developing roller with the rotation center of the image bearing member, a straight line connecting the rotation center of the developing roller with the rotation center of the recovering and feeding member, and a straight line connecting the rotation center of the developing roller with a tip end of the regulating member.

11. The color image forming apparatus described in claim 10, wherein the developing device having the different toner storing capacity has a larger outer diameter of the recovering and feeding member in comparison with the other developing devices.

12. The color image forming apparatus described in claim 10, wherein in the developing device having the different toner storing capacity, a mounting angle of the plurality of fixed magnetic poles of the fixed magnetic pole member in a peripheral direction on the developing device casing member is different in comparison with the other developing devices.

13. The color image forming apparatus described in claim 10, wherein the developing device having the different toner storing capacity is a developing device storing black developer and the other developing devices are developing devices storing color developer, and wherein the developer storing capacity of the developing device storing black developer is larger than that of the developing devices storing color developer.

14. The color image forming apparatus described in claim 10, wherein all of the developing sleeves of the plurality of developing devices has the same outer diameter.

15. The color image forming apparatus described in claim 10, wherein the developing device having the different toner storing capacity is arranged such that an angle formed by a straight line connecting the rotation center of the developing roller with the rotation center of the image bearing member and a horizontal line passing the rotation center of the image bearing member is different from the other developing devices.

16. The color image forming apparatus described in claim 10, further comprising:

a plurality of image bearing members so as to oppose one to one for the plurality of developing devices.

* * * * *